US007753715B2

(12) United States Patent
Freakes

(10) Patent No.: US 7,753,715 B2
(45) Date of Patent: Jul. 13, 2010

(54) ELECTRICAL CONNECTOR DEVICES AND METHODS FOR EMPLOYING SAME

(76) Inventor: Anthony Freakes, 3 Breckenridge Ct., Belle Mead, NJ (US) 08052

( * ) Notice: Subject to any disclaimer, the term of this patent is extended or adjusted under 35 U.S.C. 154(b) by 52 days.

(21) Appl. No.: 11/619,811

(22) Filed: Jan. 4, 2007

(65) Prior Publication Data

US 2007/0155219 A1 Jul. 5, 2007

Related U.S. Application Data

(60) Provisional application No. 60/756,264, filed on Jan. 4, 2006, provisional application No. 60/785,628, filed on Mar. 24, 2006, provisional application No. 60/792,446, filed on Apr. 17, 2006, provisional application No. 60/799,226, filed on May 10, 2006, provisional application No. 60/813,643, filed on Jun. 14, 2006, provisional application No. 60/836,159, filed on Aug. 8, 2006, provisional application No. 60/865,477, filed on Nov. 13, 2006.

(51) Int. Cl.
*H01R 4/24* (2006.01)

(52) U.S. Cl. ..... 439/395

(58) Field of Classification Search ..... 439/393, 439/399, 395, 422, 405, 417, 494; 310/236, 310/71

See application file for complete search history.

(56) References Cited

U.S. PATENT DOCUMENTS

| | | | | |
|---|---|---|---|---|
| 4,003,623 | A | 1/1977 | Reynolds | |
| 4,656,380 | A | 4/1987 | Strobl | |
| 5,022,868 | A | 6/1991 | Legrady | |
| 5,041,009 | A * | 8/1991 | McCleerey | 439/405 |
| 5,611,709 | A * | 3/1997 | McAnulty | 439/422 |
| 5,827,087 | A | 10/1998 | Yamasaki | |
| 6,132,236 | A * | 10/2000 | Kozel et al. | 439/395 |
| 2002/0160648 | A1 | 10/2002 | Bulmer et al. | |
| 2004/0077208 | A1 | 4/2004 | Brown | |
| 2005/0090139 | A1 | 4/2005 | White | |

OTHER PUBLICATIONS

International Preliminary Report on Patentability for PCT Application PCT/US2007/060097, Jan. 13, 2009 (Form PCT/IB/326/373/ISA/237).

International Search Report and written opinion for corresponding PCT application PCT/US07/60097 (forms PCT/ISA/220/210/237) dated Dec. 5, 2008.

* cited by examiner

*Primary Examiner*—Edwin A. Leon
(74) *Attorney, Agent, or Firm*—Timothy X. Gibson, Esq.; Gibson & Dernier LLP

(57) ABSTRACT

An apparatus and method are disclosed that may include a contact pin; and a plurality of loops of conductive wire, coated with insulation material, disposed in proximity to the contact pin, wherein along at least one portion of the conductive wire, at least one edge of the contact pin extends through the insulation material and thereby forms conductive electrical contact with the conductive wire.

34 Claims, 36 Drawing Sheets

ELECTRICAL CONNECTOR DEVICES AND METHODS FOR EMPLOYING SAME

CROSS-REFERENCE TO RELATED APPLICATIONS

This application claims the benefit of U.S. Provisional Patent applications Ser. No. 60/756,264, filed Jan. 4, 2006, 60/785,628 filed Mar. 24, 2006, 60/792,446 filed Apr. 17, 2006, 60/799,226 filed May 10, 2006, 60/813,643 filed Jun. 14, 2006, 60/836,159 filed Aug. 8, 2006; and 60/865,477 filed Nov. 13, 2006, the disclosures of which applications are incorporated in their entirety by reference herein.

BACKGROUND OF THE INVENTION

In a coil of conductive wire, such as a solenoid, the thinly insulated wire of the coil must be terminated at each end and joined to a source of electric power. Usually, this is accomplished by connecting each end of the coil wire to a connector which in turn connects to a larger heavily insulated power wire. Many methods exist for making the coil wire connection. Screw clamps, crimps, wire-wrapped pins, spring-loaded IDCs (Insulation Displacement Connectors), soldered joints, and welded joints, are among the most common.

When the coil wire is thick and robust, all of the above methods are satisfactory. But, when the coil wire is thin and fragile it must be handled gently and until now, soldering has been accepted as a practical low-cost industrial method for coil wires less than 35AWG (American Wire Gauge). However, soldering presents various problems.

Since July of 2006, products sold and used within the European Community have to comply with the Regulation of Hazardous Substances (RoHS) directive, which is legislation which aims to keep hazardous materials from being dumped into the environment. The element lead (Pb) is among the materials banned by this legislation.

Lead (Pb) has been used in tin/lead solder for many years and performs a stabilizing and melting-temperature-control function. The RoHS ban brought about a rush for compliance, in which "lead-free" alternative solders were developed for the electronic industry, where the use of solder is entrenched. Much study and debate continues addressing the economics and the reliability of the alternatives.

Those industries outside of the electronics industry have historically not been as wedded to the use of solder. However, where connections to coil wire below 35 AWG are sought, there has not historically been any alternative to the use of solder. In these other industries, the RoHS directive prompted lobbying for exemptions from the environmental directives banning the use of lead in solder.

Exemptions have been provided by the RoHS in recognition of the extreme difficulty of compliance with the new regulations with regard to certain applications of lead (Pb). One such exemption is where a solder must withstand a higher temperature than the melting point of the commonly used tin/lead solder or its lead-free alternatives. In these cases, high melting point solders with high lead (Pb) content are still allowed.

It is believed that the pursuit of exemptions may have been manipulated by reclassifying applications as "high temperature applications" to enable the lead-based solder to be used for high-melting-point solder. Paradoxically, this process may lead to more lead (Pb) being used than was the case prior to the imposition of the new rules. However, it is anticipated that the above-mentioned loopholes will be closed and secondly that the exemptions will in any case have a limited time span. It is anticipated that, eventually, lead-based solder will be completely banned.

Moreover, the RoHS directive is not the only impediment to using solder. Soldering is a dangerous and unpleasant task. The possibility of nasty burns is ever present and the fumes given off by the heated acid flux are unpleasant and unhealthy. Additionally, the intense study of solder that RoHS promoted exposed many failure modes, not fully recognized and understood before. Among these were such serious flaws as internal voids, age cracking, conductor corrosion, and an inconsistency of application. Perhaps the most frightening aspect is that these flaws are only discoverable by destructive examination or by x-ray. Even if the examination finds no flaws, doubt of reliability remains because of the inconsistency of soldering.

The cost and difficulty of pursuing exemptions from RoHS compliance and of the use of lead-free solder may be avoided by establishing connections with thin fragile coil wire without using solder. However, the solder-free methods of the prior art severely distorted, notched, squeezed and scraped the coil wire in order to break through the insulation and make a good connection. The use of this approach, which employs relatively high forces, incurs a limit when applied to fragile wires. This limit is defined by the point (force level) at which breakage of the wire occurs, which breakage renders the wire useless, and which therefore incurs considerably expense. Accordingly, there is a need in the art for an improved system and method for establishing conductive connections with wire, such as coil wire, without using solder, and without damaging the wire.

SUMMARY OF THE INVENTION

One or more embodiments of the system and method disclosed herein may include the wire wrapping of rectangular sectioned pins. Desirable results may be obtained by tightly winding the wire around the pin. Each time the wire is forced to bend around a corner of the pin, tight, intimate contact may be made. The use of plural wraps may establish plural corresponding points of conductive electrical contact.

If the corners of the pin are very sharp, such as are naturally formed on the die side during punch and die stamping, then such a wire wrapping method may be employed to penetrate coil wire insulation. However, current wire wrapping methods are limited to heavy gauge wires due to the fragility of fine wires. Wires below 36 AWG are susceptible to tension break due to the magnitude of the forces required to bend, notch, and penetrate the insulation together with the stress concentration effect of the notching.

Some embodiments of the present invention can be used on wire as fine as 42 AWG without breakage of the wire. In at least one aspect, the present invention includes the gentle skiving removal of the thin insulation of a coil wire by a sharp edge of a connector, thereby making electrical contact. This can be done on one wire when the wire is robust or on a plurality of load sharing fragile wires. Helically wrapping the wire presents one wire as if it were a plurality of wires from the vantage point of the connector.

In one aspect, a method of penetrating insulation includes scraping the insulation longitudinally along the wire. This scraping action may also scrape the conductor material of the wire to produce a good clean contact area. The foregoing step may be performed on only one side of the wire to avoid excessively reducing the wire diameter. Furthermore, this insulation removal and contact action may be applied to several locations along the wire, thereby creating many parallel electric paths. This action is conducive to adequate conductivity while spreading the scraping force loading over many points.

Another embodiment of the present invention may include a method of preparing the ends of the coil wires by wrapping the wires around structures incorporated within a bobbin molding. These structures support the wraps while providing access to the internal region of the wraps, or "wire loops". Appendages on the subsequently introduced connectors then impinge, skive, and thereby make electrical contact with the coil wire conductor material. Various connector designs employing differing methods of deflecting the wire may be practiced.

In one or more embodiments, molded portions of the bobbin may be strategically located to anchor the wires. These anchoring structures allow the space available to receive wire loops to be filled before the connectors are assembled. Assembling the connector to the bobbin may include inserting a contact pin extending from the connector through a hollow in the bobbin that is configured to receive the contact pin. Insertion of the contact pin in this manner causes one or more edges of the contact pin to extend through the insulation material and thereby form conductive electrical contact with conductive wire in one or more of the wire loops that are wrapped around the bobbin.

One or more embodiments of the present invention may include converting the above-described temporary anchoring structures into permanent supports for the wire wraps that will be contacted by the later introduction of a connector.

There are at least two major avenues through which the systems and methods disclosed herein may be beneficially applied. These are defined by the order of assembly. In one avenue, the connector may be assembled into the coil bobbin after the coil is wound. In another, the connector may be assembled into the coil bobbin before the coil is wound. When the connector is assembled after winding the coil, the wire may be prepared for introduction of the connector by wrapping conductive wire around bobbin structures in preparation for introduction of the connector. When the connector is assembled before the coil is wound, the connector provides the structure around which the wire ends may be wrapped.

When the connector is assembled prior to coil winding, in one embodiment, an appendage of the starting connector is presented at an advantageous location so that the natural positioning of the wire guide of the coil winding machine can easily wrap the appendage with coil wire to anchor the coil wire at the start of the coil. Then, at the end of the coil winding, the coil wire is anchored and wrapped around a similar appendage of the finishing connector. This is presently done to present anchored wire ends for the prior art of soldering the wire to the connector.

In a further embodiment, the invention may include novel designs for specially shaped connector appendages. In some embodiments, the wire wraps on the appendages may be moved along the appendage to skive, scrape and make electrical contact between the wire and the connector, while not unduly stressing the wire. During such a wire moving (which may include pushing and/or pulling of one or more wire loops), the shape of the connector appendage may influence the changes in wire tension imparted to the various wire loops by the wire moving operation. For example, where the cross-sectional perimeter of the appendage increases in the direction in which the wire is moved, tension in the moved wire loops may increase with increasing travel of the wires. After the wire loops have been placed in a final desired location, the appendage and wire loops may then be protected, sealed, and/or locked in place by placing shrink wrap material about the appendage and wire loops.

Other aspects, features, advantages, etc. will become apparent to one skilled in the art when the description of the preferred embodiments of the invention herein is taken in conjunction with the accompanying drawings.

BRIEF DESCRIPTION OF THE DRAWINGS

For the purposes of illustrating the various aspects of the invention, there are shown in the drawings forms that are presently preferred, it being understood, however, that the invention is not limited to the precise arrangements and instrumentalities shown.

DETAILED DESCRIPTION OF THE PREFERRED EMBODIMENTS

An embodiment of the present invention provides an electrical connector that will adequately and consistently displace the insulation surrounding the magnet wire to make an effective, gas tight electrical connection between the conducting material of the wire and the material of the electrical connector. One or more embodiments provide a connector that may establish an effective, gas tight electrical connection over a large range of magnet wire sizes.

In the following description, for purposes of explanation, specific numbers, materials and configurations are set forth in order to provide a thorough understanding of one or more embodiments of the invention. It will be apparent, however, to one having ordinary skill in the art, that the invention may be practiced without these specific details. In some instances, well-known features may be omitted or simplified so as not to obscure the present invention. Furthermore, reference in the specification to "one embodiment" or "an embodiment" means that a particular feature, structure or characteristic described in connection with the embodiment is included in at least one embodiment of the invention. The appearances of the phrase "in an embodiment" in various places in the specification are not necessarily all referring to the same embodiment.

Figure 1:
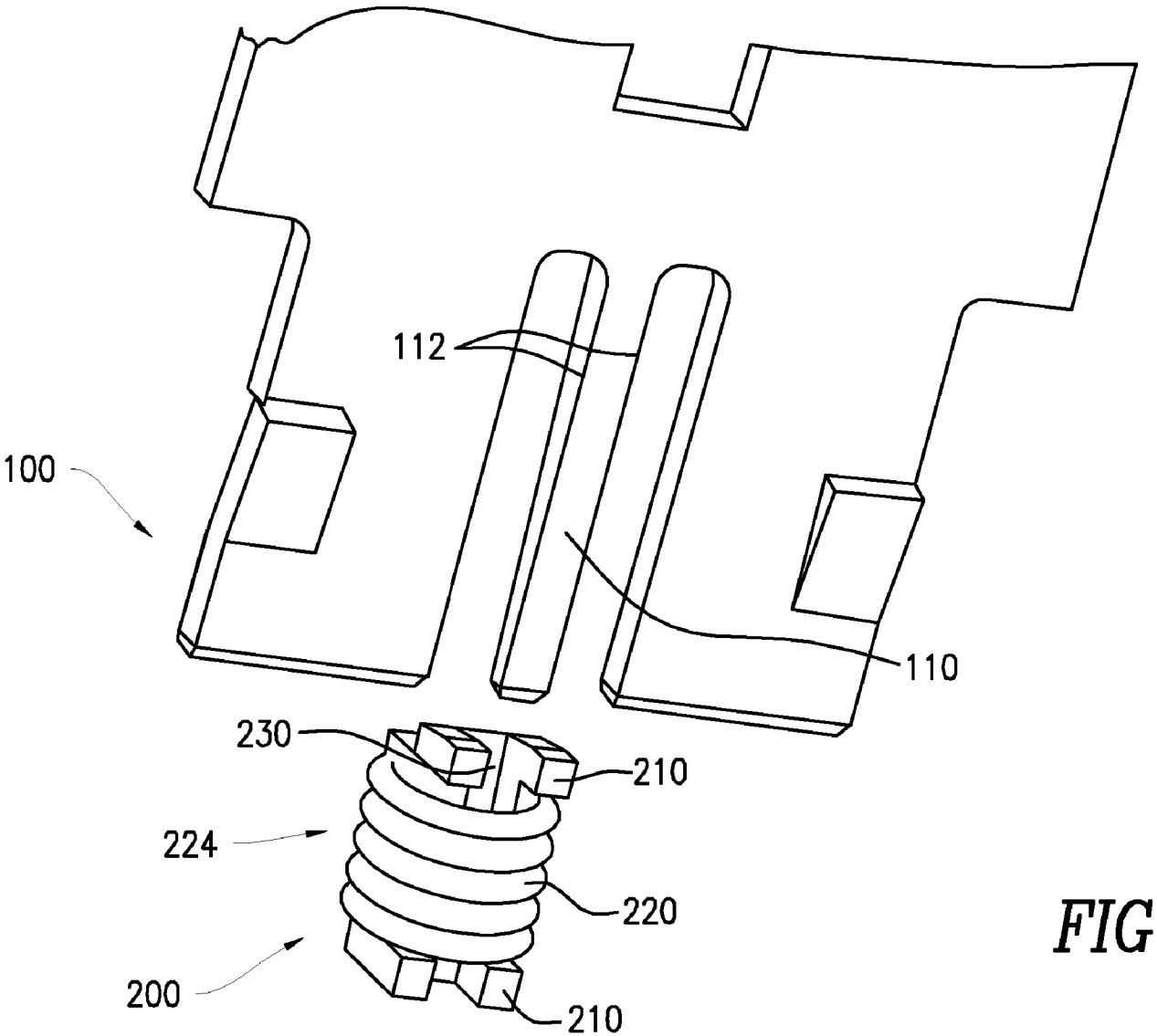
FIG. 1. is a perspective view of a connector and a post (or "bobbin") in accordance with one or more embodiments of the present invention.
Figure 2:
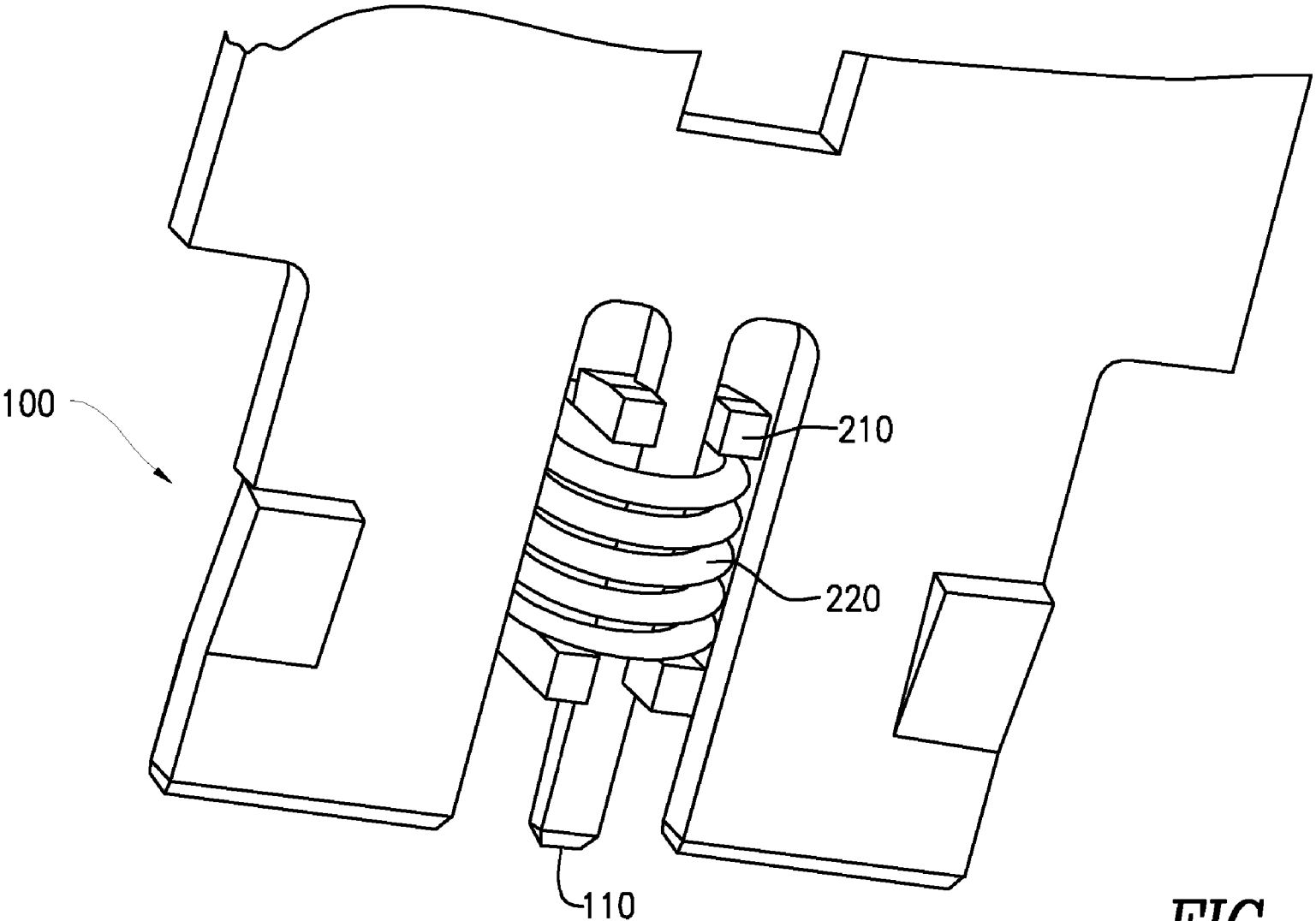
FIG. 2 is a close up perspective view of the connector of FIG. 1 after insertion of the connector pin into the bobbin, in accordance with one or more embodiments of the present invention.
Figure 3:
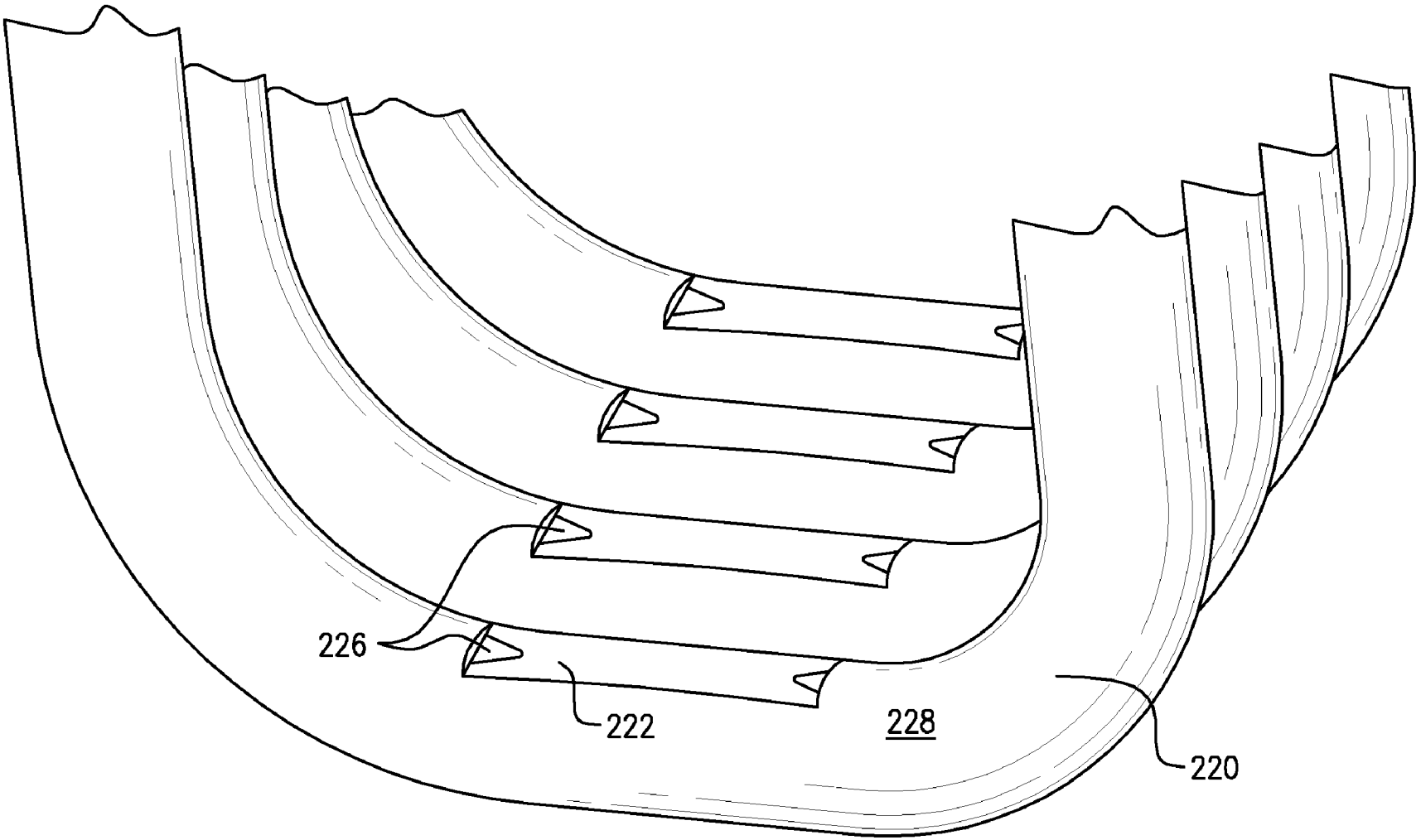
FIG. 3 is a close up perspective view of a magnet wire in which cuts from the connector pin penetrate the insulation skin of the magnet wire, in accordance with one or more embodiments of the present invention.

Now referring to FIGS. 1, 2 and 3 a connector 100 and a post (or "bobbin") 200 are shown in accordance with an embodiment of the present invention. Now referring to FIG. 2, the connector 100 of FIG. 1 is depicted after insertion of the connector pin 110 into the bobbin 200, in accordance with an embodiment of the present invention.

Connector 100 may include connector pin 110 which may be stamped so as to include edges 112 thereon. Bobbin 200 may include anchor posts 210 and a groove 230 configured to receive connector pin 110. Wire 220 may be wrapped about bobbin post 210 to form a plurality of loops 224. Wire 220 may be coated with insulation 228. Bobbin 200 and bobbin post 210, may be made of plastic. However, materials may be employed for bobbin 200 and bobbin post 210 such as but not limited to metal (which may be insulated), ceramic, or other suitable materials known to those having ordinary skill in the art.

One or more embodiments of the present invention may provide electrical connector 100 for connecting two or more wires 220 together. Connector 100 may be quickly and efficiently produced with a stamping method using a progressive blanking die. This manufacturing method may be characterized by the occurrence, in the blanked part, of natural rounded edges on the punch entrance side of the part and sharp edges on the opposite (die) side. It is these sharp edges 112 that may be used to enable contact pin 110 to cut into the insulation 228 and thereby establish conductive electrical contact with the conducting material of the coil wire.

Now referring to FIG. 3, wire 220 is shown, which may be coil wire, in which cuts from the connector pin 110 may penetrate the insulation skin 228 of the coil wire 220.

Wire 220 may be wound around bobbin 200 before or after the insertion of contact pin 110 into groove (or "hollow" or "hollow portion") 230 of bobbin post 210. Attention is directed below to an embodiment in which wire 220 is wrapped about bobbin post 210 prior to the introduction of contact pin 110 into the groove 230. One wire 220 may be employed and wrapped to create a plurality of wire loops 224. Alternatively, a plurality of separate wires 220 may be employed and may each be wrapped one or more times to provide loops 224 that extend across groove or hollow portion 230 of bobbin post 210.

A method in accordance with one embodiment may include wrapping wire loops 224 about bobbin post 210. The wire loops 224 bridge across the groove 230, such that when the connector 100, which may include a wedge shaped pin 110, is later inserted into the groove 230 of the bobbin post 210, the combination of bobbin post 210 and wire loops 224 are suitably configured to receive contact pin 110. Once bobbin 200 is suitably configured as described, contact pin 110 may be inserted into the groove 230 (FIG. 2). Insertion of contact pin 110 into groove 230 preferably causes pin 110 to wedge against wire loops 224 and causes sharp edges 112 of pin 110 to impinge, press and cut, like a stroke of a knife, into the insulation 228 of the wire loops 224 that bridge across groove 230. This wedging force preferably creates tensile stressing of the loops 224 of wire(s) 220 which thereby applies a load against wire loops 224 that prevents vibration and temperature variation from loosening the contact between pin 110 and wire loops 224. Such loading can be increased by inserting pin 110 progressively deeper into the wire loops 224 until a sufficiently firm, gas-tight contact is made between pin 110 and wire loops 224. Thereafter, wire tension aids in preserving the conductive electrical contact between pin 110 and wire loops 224.

In one embodiment, anchor posts 210 are used to anchor the beginning and the end of wire 220 of the coil by wrapping the wire around such posts 210. Anchor posts 210 are shown only in schematic form in FIGS. 1 and 2, however, the implementation of such anchor posts 210 is known to those of ordinary skill in the art.

In one embodiment, the anchor posts 210 that anchor the two ends wire 220 are converted into small coil forms, (around which many turns of coil wire 220 are wound tightly), which may have grooves therein to allow the introduction of the insulation 228 cutting blades of the connector 110 to impinge against the inner portion of wire loops 224.

In at least one embodiment, means are provided to move the anchor posts 210 into the body of the bobbin 200 and to align anchor posts 210 into the proper path of the connector 11 0. Thus, otherwise stated, in this embodiment, the anchor posts 210 are incorporated within the body of the bobbin. One such embodiment may enclose within the body of the bobbin 200 all anchor posts 210 and wire 220 ends, so that no trimming of these parts is required. Another embodiment may provide a system and method in which the connection, sealing, taping and/or testing of a pin 110—bobbin 200 assembly are completed within a coiling machine, so that finished coils are completed in a cycle time corresponding to that of a coil winding operation, thereby enabling eliminating one or more further secondary operations.

FIG. 3 shows the skiving action of pin 110 against insulation 228 and wire 220. Insulation 228 of wire 220 is preferably carved or removed in areas 222. Conductive electrical contact between pin 110 and wire 220 may be established in contact areas 226. In other embodiments, contact between pin 110 and scraped metal of wires 220 may occur on parts of wire loops 224 other than those shown in FIG. 3, and all such variations are intended to be included within the scope of the present invention.

With reference to FIGS. 4A-5C, the skiving action on the coil wire 220 by a pin or "lance" 110 in the connector 100 of the one or more embodiments of the present invention is further described below.

Figure 4A:
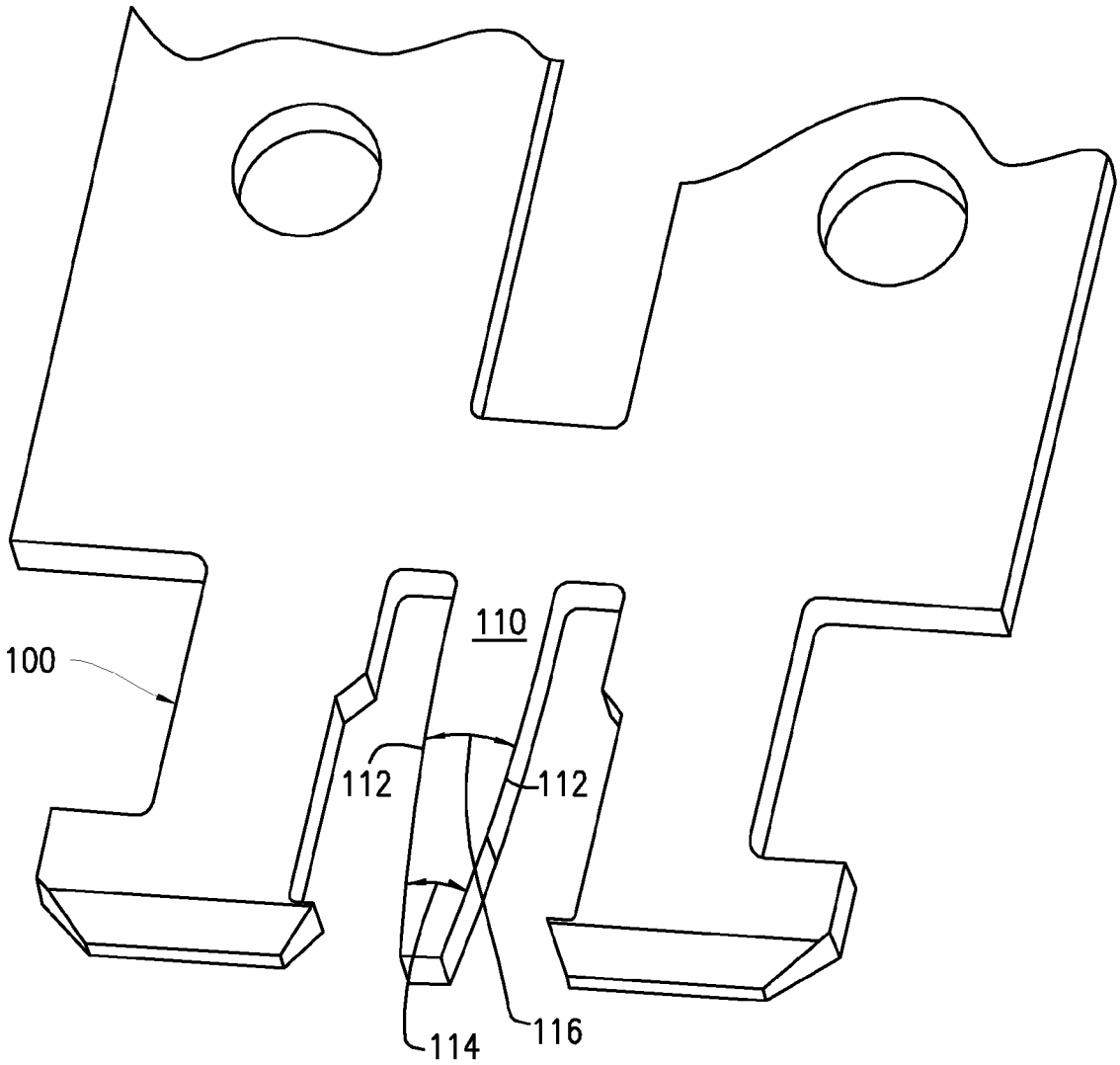
FIG. 4A is a close up perspective view of a connector lance with two taper angles, in accordance with one or more embodiments of the present invention.

FIG. 4A depicts a connector 100 having connector pin (or "lance") 110 with two taper angles 114, 116 along its length, in accordance with one or more embodiments of the present invention. As discussed in greater detail below, the taper angles 114, 116 may be customized to suit particular applications.

Figure 6:
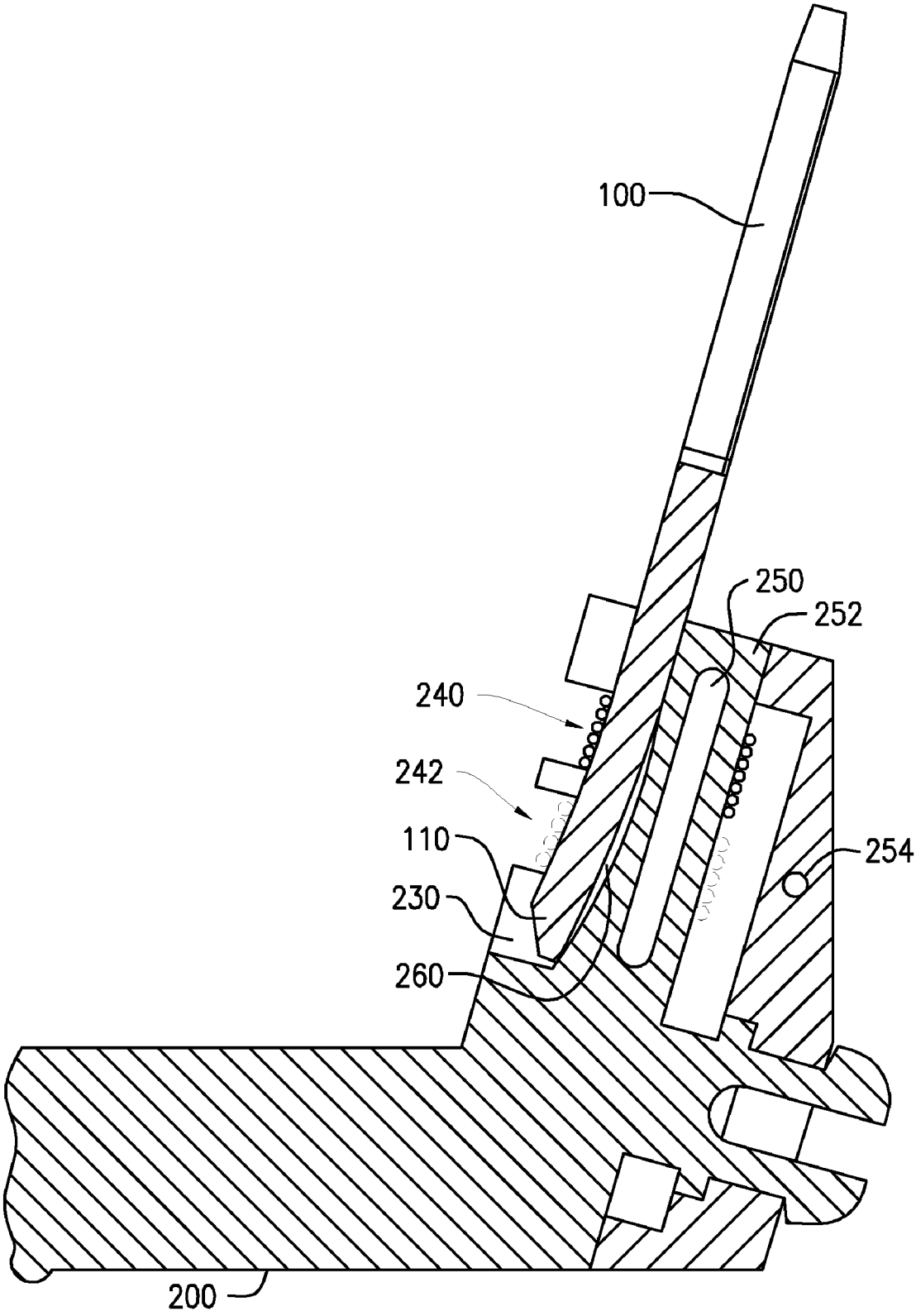
FIG. 6 is a sectional drawing showing the deflection of the connector lance and wire contact in accordance with one or more embodiments of the present invention.

In one or more embodiments, when connector 100 is inserted toward bobbin 200, or other entity, so as to lead with the narrow tip of connector pin 110, the tip of pin 110 may impinge against a sloping surface (or "ramp"), that may be molded into the bobbin 200, which sloping surface may urge the lance 110 to deflect towards the inner part of the coil wire wrapping. Such a ramp is shown in connection with FIG. 6 below FIG. 6 shows lance 110 of connector 100 inserted into bobbin 200. Lance 110 extends through fine wire loop section 240, robust wire loop section 242. Bobbin 200 can include window 250 to provide resiliency, connecting post 260, protective cap 254, and ramp 260 at the bottom of the groove 230. Ramp 260 operates to deflect the distal end, or tip, of lance 110, thereby causing lance 110 to impinge on wires in sections 240 and 242. The deflection causes lance 110 to stretch and skive the wires in at least the fine wire loop section 240.

This impinging action may cause the tapered sharp edges 112 to contact the wire 220 surface (which may include insulation 228). As the connector 100 is advanced with respect to bobbin 200, the lance 110 may be further deflected, thereby enabling lance 110 to apply a progressively increasing force against wire 220 insulation 228. Because of the movement of lance 110 and the force applied against the wire insulation 228, and because the sharp edges 112 of the lance 110 may be tapered, the insulation 228 on the wire loops 224 may peel in the insulation 228 region 604 (FIG. 5A) where the lance 110 edges 112 makes contact. Each individual wire wrap in contact with the lance 110 may receive two "bites" or "skiving regions" in which the insulation 228 is peeled along the longitudinal axis of wire 220. Generally, the two pertinent regions of wire 220 insulation 228 will experience skiving in opposite directions along the longitudinal axis of wire 220 as lance 110 advances with respect to the wires, as shown in FIG. 5B. Generally, contact pin (lance) 110 may cut into wire 220 insulation 228 in a lateral direction, that is, a direction at least substantially perpendicular to a) the longitudinal axis of contact pin 110 and to b) a direction of advancement of contact pin 110 with respect to bobbin 200. (FIG. 2).

Referring to FIG. 4A, the taper angle 114 may be varied from one connector pin 110 to another, and may even be varied along the length of a single connector pin 11 0. The taper angle 114 may have a direct influence on the peeling distance (FIG. 5A), and may therefore in turn affect the length 604 (FIG. 5A) of conductor wire 220 that is exposed, or otherwise stated, rendered free of insulation 228.

Variation of the taper angle 114 may be controlled to bring about desired effects in the process of inserting a connector pin 110 into one or more wire loops 224 to establish conductive electrical contact between the pin 110 and the wire loops 224. Moreover, taper angle 114 may be adjusted to suit the needs of different applications. In one embodiment, lance 110 may be designed to have a gentle taper (that is, with the edges 112 being disposed a relatively small acute angle with respect to the longitudinal axis of the pin 110) where it operates on thinner wires in a fine wire zone of a connector post and a wider taper angle when operating on thicker wires in a robust wire zone, thus producing longer peels on the robust wires. This can be achieved by providing lance edges 112 that have distinctly different taper angles 114, 116 at different points along their length, or by providing curved cutting edges 112.

For example, in some embodiments, the taper angle (measured with respect to the longitudinal axis of the pin or lance 110) may be between five and seven degrees, and more specifically, about six degrees. In other embodiments, the taper angle may be between thirteen and seventeen degrees, and more specifically, about fifteen degrees. In still other embodiments, the taper angle could have any value above or below six degrees, and all such variations are intended to be included within the scope of the present invention.

Figure 4B:
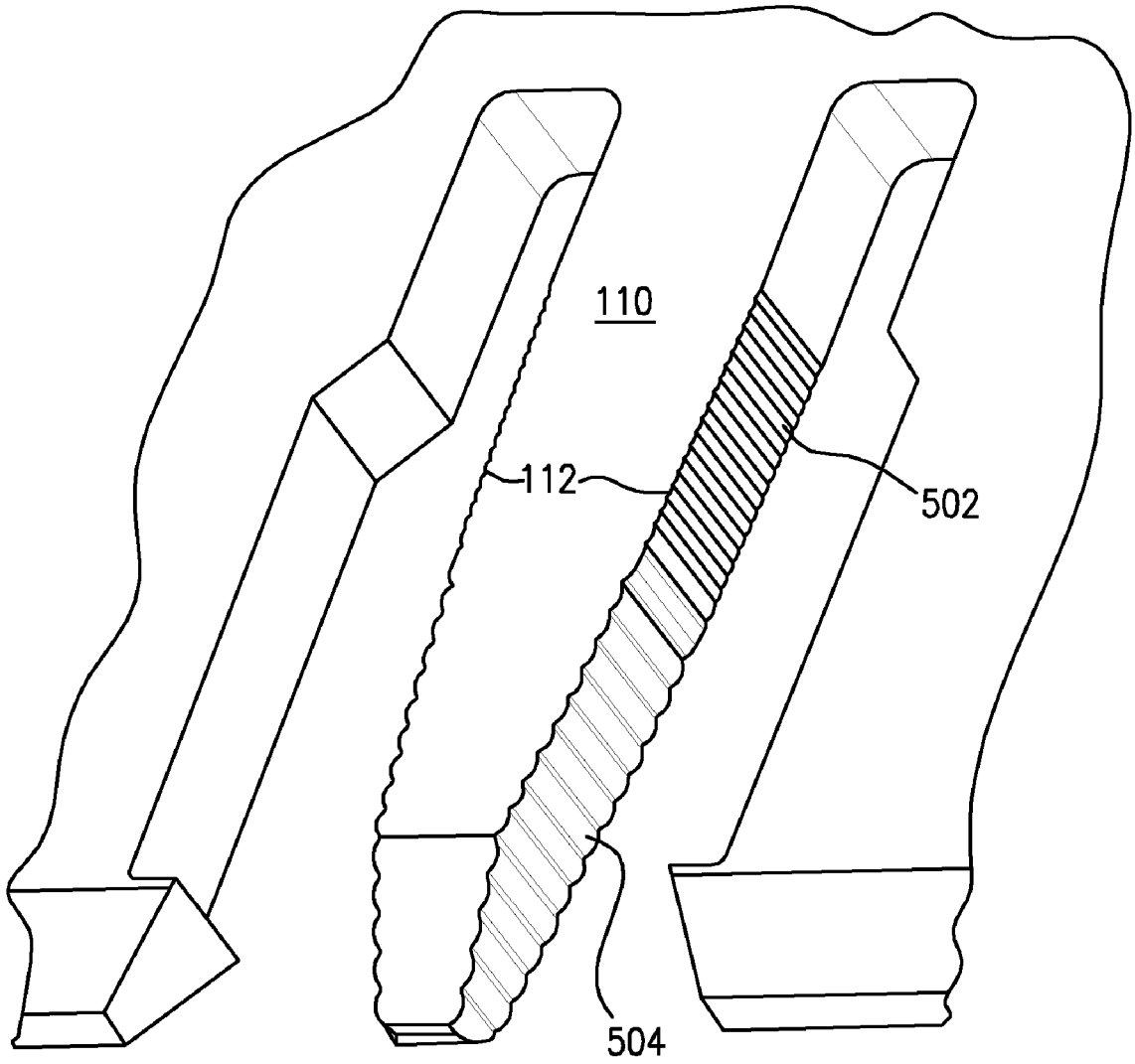
FIG. 4B is a close up perspective view of a connector lance with serrated edges, in accordance with one or more embodiments of the present invention.

FIG. 4B shows a connector pin or lance 110 having serrated edges 112, in accordance with one or more embodiments of the present invention. Consistent with the needs of varying applications, lance 110 may include fine serrations 502 and/or coarse serrations 504.

Cutting edge serrations 502, 504 may be effective when dealing with tough insulation 228 material. The dimensions of the serrations and/or the length of the gaps separating successive serrations may be varied among different connector pins 110 based on the benefits that may be obtained therefrom in different applications. For example, in one embodiment, serrations 504 may be coarse near the tip of the lance 110 and fine near the root, thereby enabling pin 110 to impinge more aggressively on a wire when the wire is thicker.

One method of making serrations during stamping tool making may include simply speeding up the wire Electrical Discharge Machining (EDM) process. Speeding up the EDM process as described, may generate a coarse cut on pin 110, and may thereby produce a relatively rough edge 112 which may include the serrations 502, 504 sought in this embodiment of the invention.

The above-described devices for skiving wire 220 differently in different applications may be effective because the ramped groove in the bobbin or connector post 200 may allow the tip of the connector pin or lance 110 to clear the wire 220 in the delicate wire zone as the connector pin 110 is inserted. When suitable lance 110 geometry is established, the lance may be deflected so as to impinge against and skive the wires 220 with suitable cutting force and suitable insulation 228 removal, only when the lance 110 tip insertion proceeds beyond a delicate wire zone of a plurality of wire loops 224.

Referring to FIG. 5B, lance 110 may move in direction 520. FIG. 5B shows the position of lance 110 edges at the beginning 530 of a skiving motion, and at the end 532 of the skiving motion.

Figure 5A:
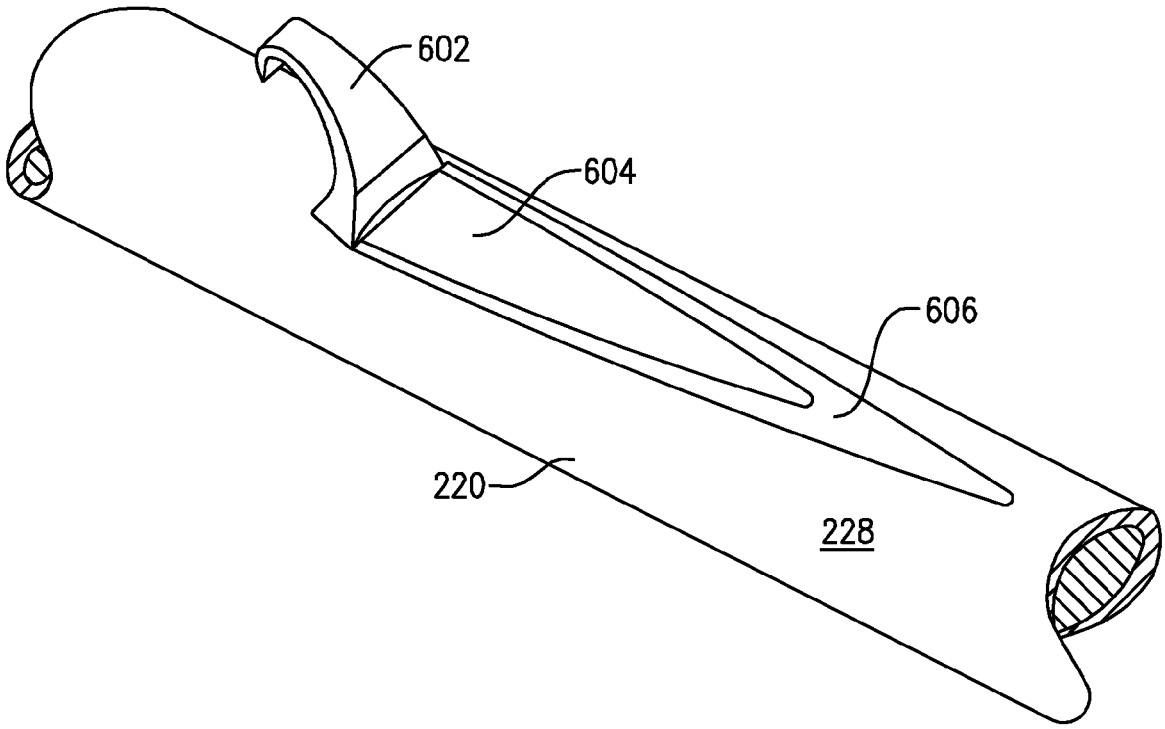
FIG. 5A is a close up perspective drawing of the skiving of a magnet wire, in accordance with one or more embodiments of the present invention.
Figure 5B:
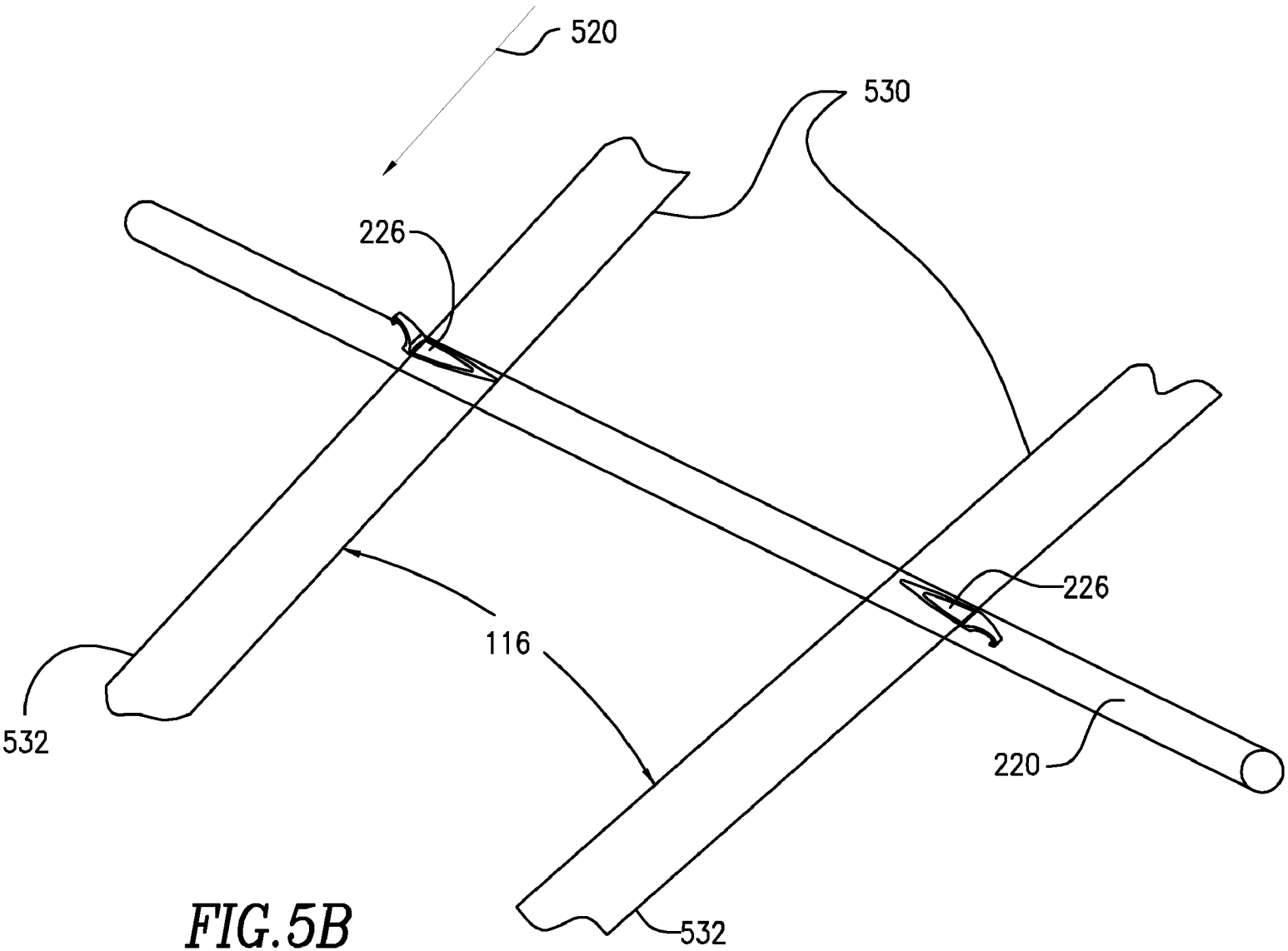
FIG. 5B is a perspective view of the skiving action in accordance with one or more embodiments of the present invention.
Figure 5C:
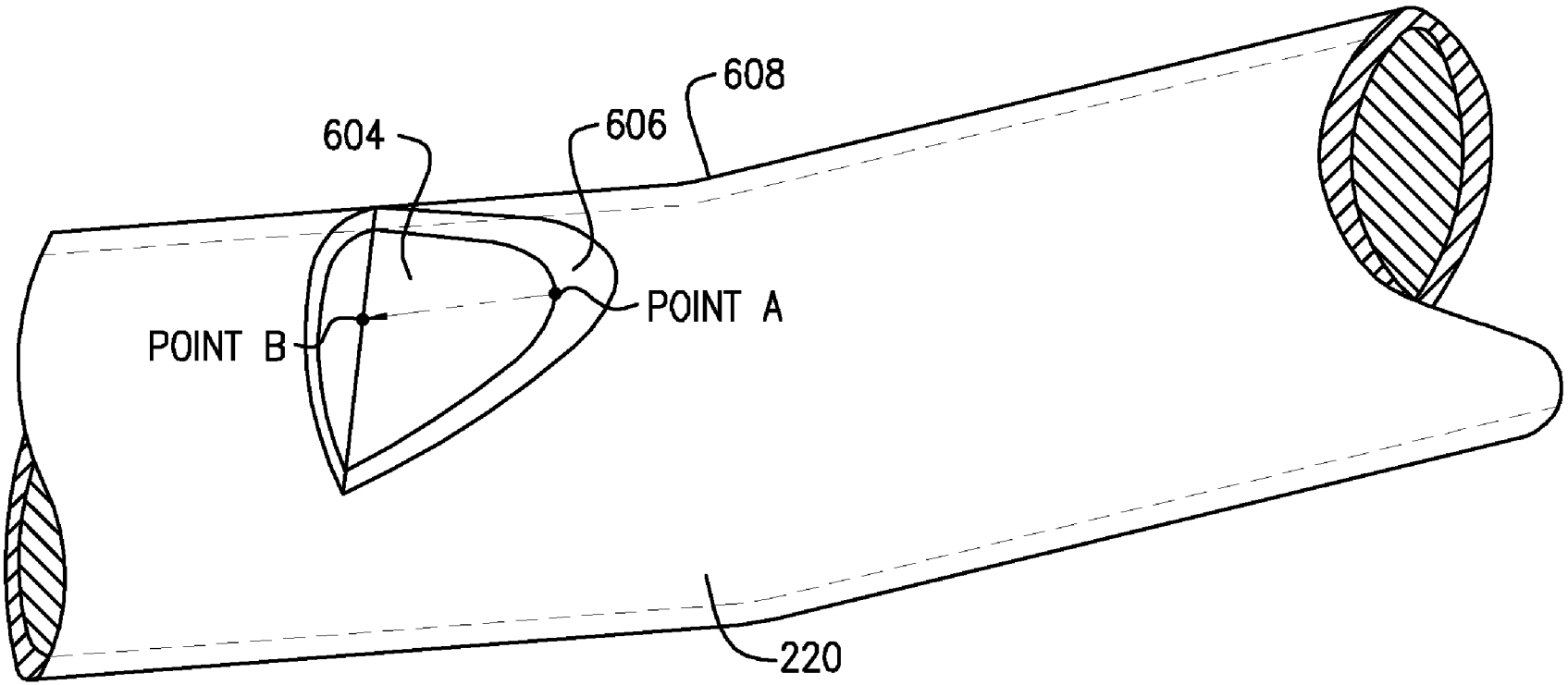
FIG. 5C is a close up perspective view of the skiving of insulation coating a wire in accordance with one or more embodiments of the present invention.

The effects of lance 110 impingement on the surface and structure of wire 220 is now considered in greater detail with regard to FIGS. 5A and 5C. FIG. 5A shows the skiving of a coil wire 220; and FIG. 5C shows the skiving of insulation 228 coating a wire 220 in accordance with one or more embodiments of the present invention. With regard to FIG. 5A, the effects of skiving wire 220 are addressed in greater detail. Upon cutting into wire 220, pin 110 may cut insulation shard 602 away from other insulation material 228. Moreover, the cutting or skiving action may leave several distinct layers on wire 220, including the original surface of insulation 228, a skived insulation portion 606 (FIGS. 5A and 5C), and/or bare conductive wire metal 604. In addition to baring metal 604, the impingement of pin or lance 110 on wire 220 may be operable to scrape away undesirable substances on metal surface 604, such as oxides, or other materials tending on inhibit the establishment of electrically conductive contact with pin 110. The tension in the wire 220 and the resiliency of the deflected lance 110, may combine to create gas-tight contact even during temperature variance and vibration.

In addition to the effects of skiving on the outer surface of wire 220, skiving of wire 220 by lance 110 may in some cases cause wire 220 to be stretched and bent or kinked along its own longitudinal axis, as shown in FIG. 5C.

Experiments have demonstrated that the skiving of fine wire (i.e. below 36 AWG) may be conducted more effectively using a shorter peel distance. Conversely, the skiving of robust wire (i.e. above 30 AWG) may benefit from the use of a longer peel distance.

When establishing contact between connector pins 110 and fine wires 220, the skiving pressure (or "impingement force"), that is, the force compelling the wire 220 against the sharp edge of the connector pin 110, may have consequences for wire 220. If the impingement force is too high, the wires 220 may be excessively weakened or, in an extreme case, severed. If the impingement force is too low, the tension in the wire 220 may not be sufficient to maintain gas-tight contact with connector pin (lance) 110 during duty in a working environment. The impingement force may be affected by the tension in the wire 220 during wrapping of the wire 220 about the bobbin 200, and secondly by the dimensions of the bobbin 200 or connector post 210 and the connector pin 110.

In most cases, the wrapping tension used to wrap wire 220 may be close to the normal tension for coil winding. However, if this tension should prove not to be ideal, then the tension may be modified for a post-wrapping operation. Thereafter, the coil tension used in the pertinent coil wrapping machine may restored to its normal value. There are many means for making the tension adjustment including, but not limited to pneumatic dancers and wire straighteners, as will be apparent to those skilled in the art of wire handling.

One or more embodiments of the invention depicted in FIGS. 4A-5C may contain numerous wire 220 loops 224 wound around a bobbin post 210 with a connecting lance 110 inserted internally within the loops 224. In other embodiments, a single loop may be employed. When employing a single loop, a sharp edge may be used to impinge on wire 220 which may skive the wire 220, displace the insulation 228, and scrape the conductor metal such that a gas-tight conductive connection is established between the conductor metal of the wire 604 (FIGS. 5A and 5C) and the metal of the connector pin 110. This single-wrap (or single-loop) embodiment may be employed in other configurations as well. For example, the connector pin 110 may located externally of the wire 220 wrap and may therefore impinge against the outer part of the post 210 wrapping. In addition, a single wire 220 may be employed, which wire 220 may be supported by means other than a post. In this single-wrap embodiment, the skiving action may be similar or the same as what has been described in connection with earlier embodiments. Such skiving action may displace wire 220 insulation 228 and may establish electrically conductive contact between wire 220 metal 604 and connector pin 110.

Figure 7:
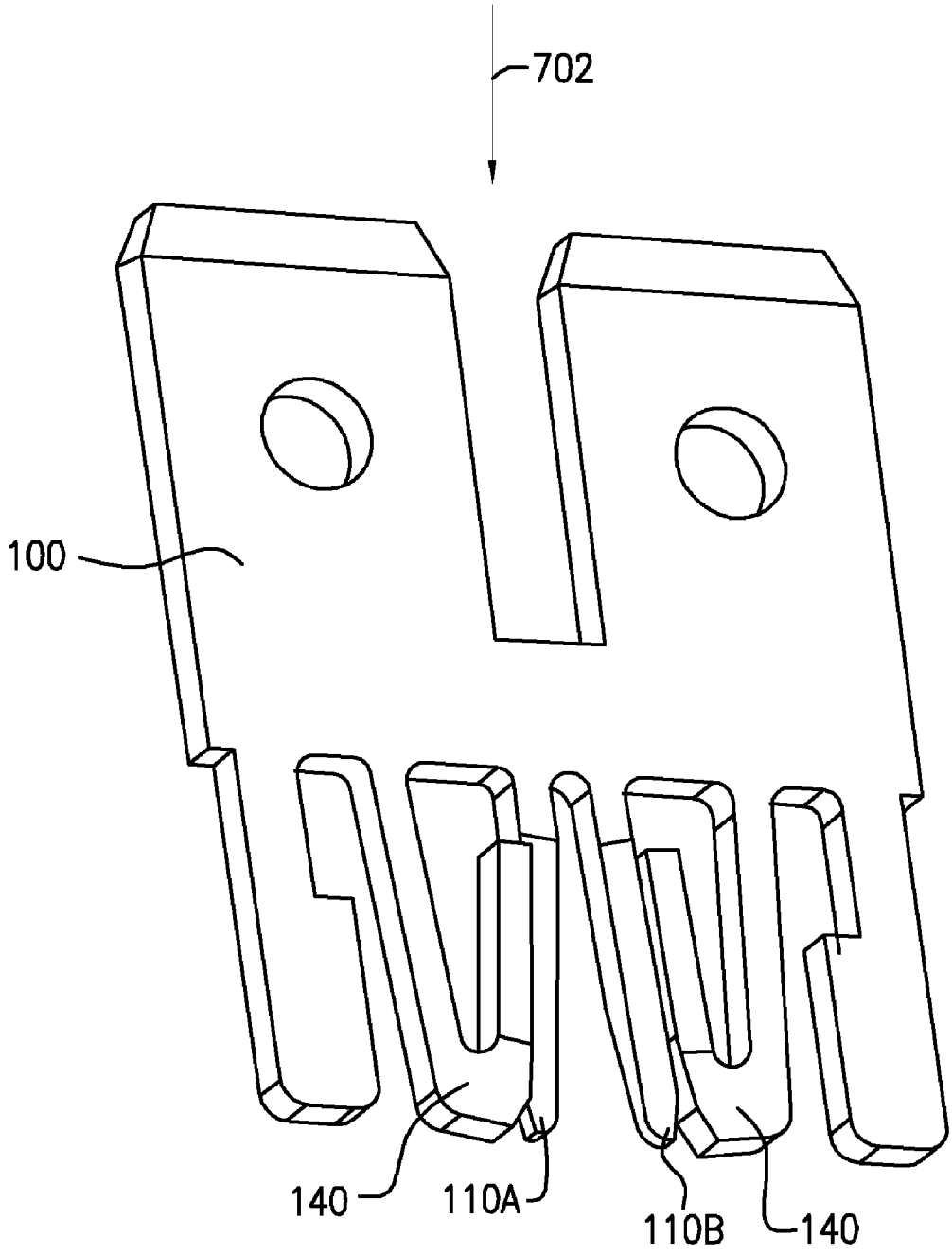
FIG. 7 is a perspective view of an embodiment of a connector as deflected when assembled in accordance with one or more embodiments of the present invention.

FIG. 7 shows the shape that the lances 11A, 110B will assume when the connector 100 is assembled into the pocket 280 of the bobbin 200. The lances 110 are forced into this position by impinging against appropriate curved surfaces in the contact post on the bobbin 200.

Figure 8:
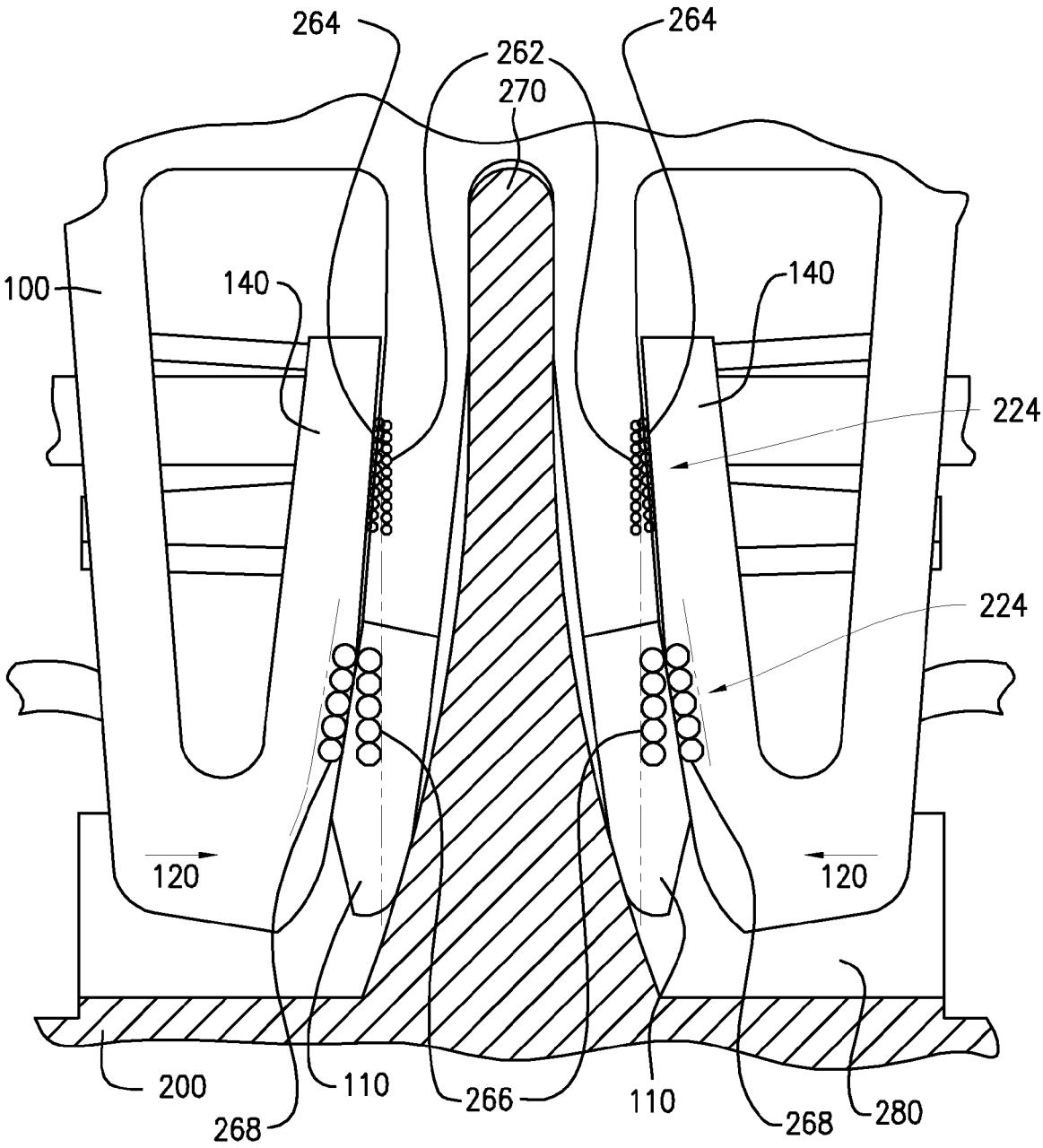
FIG. 8 is a sectional view of an embodiment of a lance interaction with a post in accordance with one or more embodiments of the present invention.

Referring to FIG. 8, during assembly, the connector 100 moves so that the gap first encloses the wire wraps and then the skiving lance 110 impinges against a rising cam surface 270 of the bobbin post slot which compels the lance 110 to move towards the wire 220 thus closing the gap. Further assembly movement causes the sharp edge of the lance 110 to cut into the insulation layer 228 of the wire 220. As the cutting edge is at an angle to the motion of the connector 100, further movement skives the insulation 228 and scrapes the conductor metal 604 (FIG. 5A) making an electrical contact. The lance 110 is deflected during this process so that the wire wraps 224 are stretched outwards, and impinge against and deflect the spring in opposition to spring force 120. This creates a maintained spring loaded contact which serves to maintain the electrical contact even if the wire tension is reduced due to plastic creep of the bobbin 200 post. This spring loaded contact is first stabilized by the tip of the spring latching in the bobbin 200 post and subsequently more firmly stabilized by elements in the total assembly that impinge against latch ledges built into the connector 100.

Upon impingement by lance 110 of connector 100, the fine wires may be pushed from their initial position 262 into a their final position 264. Similarly robust wires may be pushed from their initial position 266 into their final position 268.

Although the above methods of deflecting parts of the connector 100 by employing a cam 270 surface in the bobbin structure have proved effective, there is concern about the long term possible relaxation of the plastic parts (plastic creep) and a possible detrimental change that relaxes the contact pressure. Additional embodiments are depicted in FIGS. 9-14, which do not require direct impingement of the deflecting connector lance against a plastic cam, are presented, thereby addressing the above concerns.

In these embodiments, a portion of the metal of the connector is stamped and retained and used as a wedge 130, which is urged into a narrowed opening between a pair of lances 110, thereby opening the lances 110 to impinge and scrape and make electrical contact with the coil wire wraps 224. The urging of the wedge 130 is accomplished by the action of inserting the connector 100 into the bobbin 200. The wedge impinges against a plastic surface of the bobbin and enters the space between the lances and reaches a point where it is beyond having any back reacting force. Plastic creep then has no effect.

Now referring to FIGS. 9-14, further embodiments of the present invention are shown. There are instances in which the bobbin material is not always designed with the coil wire connection method in mind. In such cases, other considerations, such as the insulation properties of the bobbin 200 and the bobbin's 200 ability to cope with the environment are more important, and the material of the bobbin is weaker and possibly less rigid than would exist in the optimal case. In particular, using the bobbin 200 material surfaces to impinge on and deflect metal features of the connector 100 and to then hold those features in a fixed position during the life of the assembly may exceed the performance characteristics of some materials.

Therefore, in instances where the conventional material is not strong and hard enough to perform the duties required in the foregoing embodiments, other embodiments are provided. In accordance with at least one embodiment, a method is provided for deflecting the connector elements that does not rely on the strength and hardness and long term stability of the bobbin 200 material.

Figure 9:
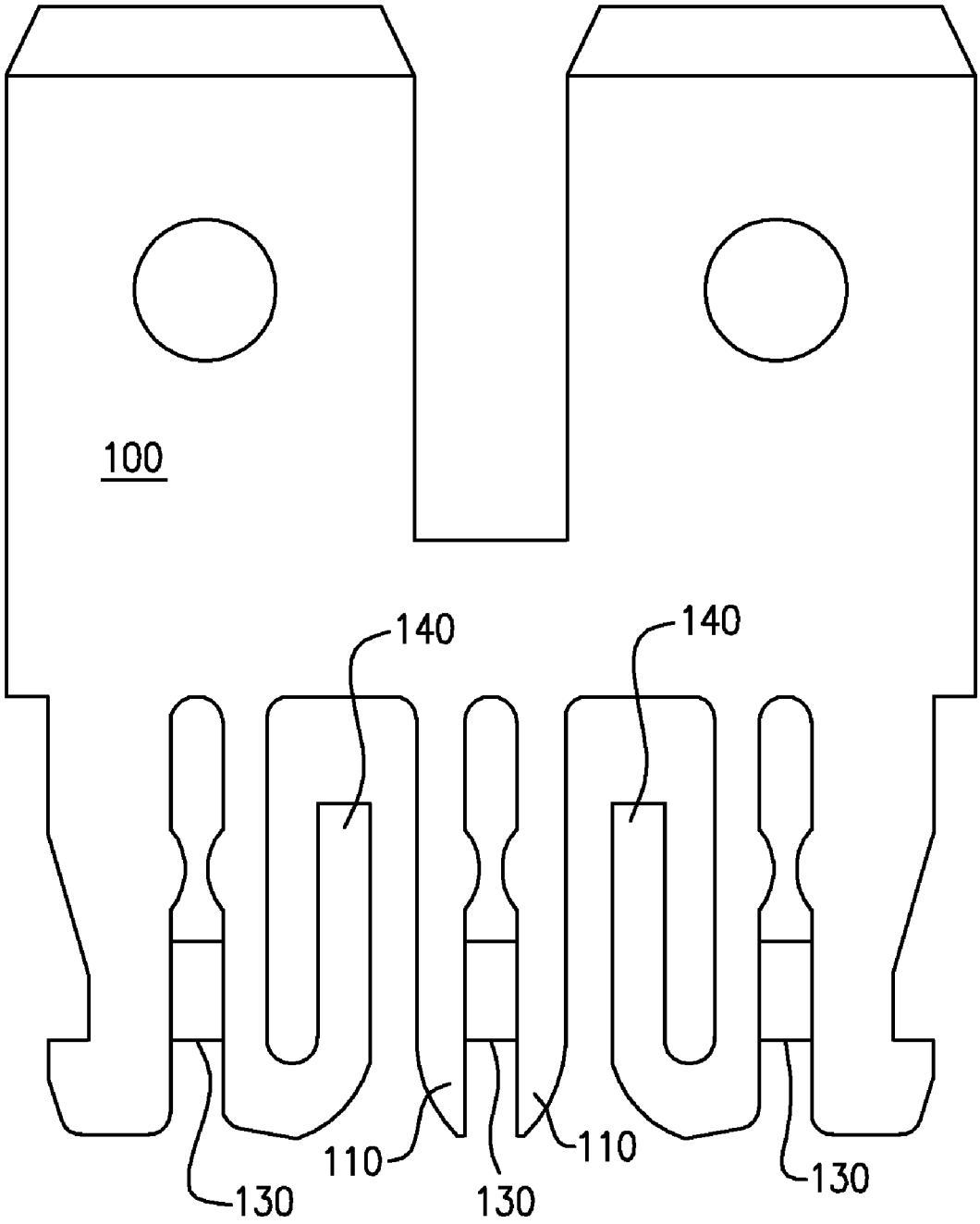
FIG. 9 is a front plan view of an electrical connector in accordance with one or more embodiments of the present invention.

FIG. 9 shows a typical connector 100 that includes the additional feature of bridges 130 of material that are located within the lances 110 and spring fingers 140. When separated, so that they are movable, these bridges 130 (also referred as slugs or wedges) serve to wedge and deflect the lances 110 and springs 140 as desired during assembly into the bobbin 200, thereby securely forcing lances 110 and springs 140 into their desired positions.

Figure 10:
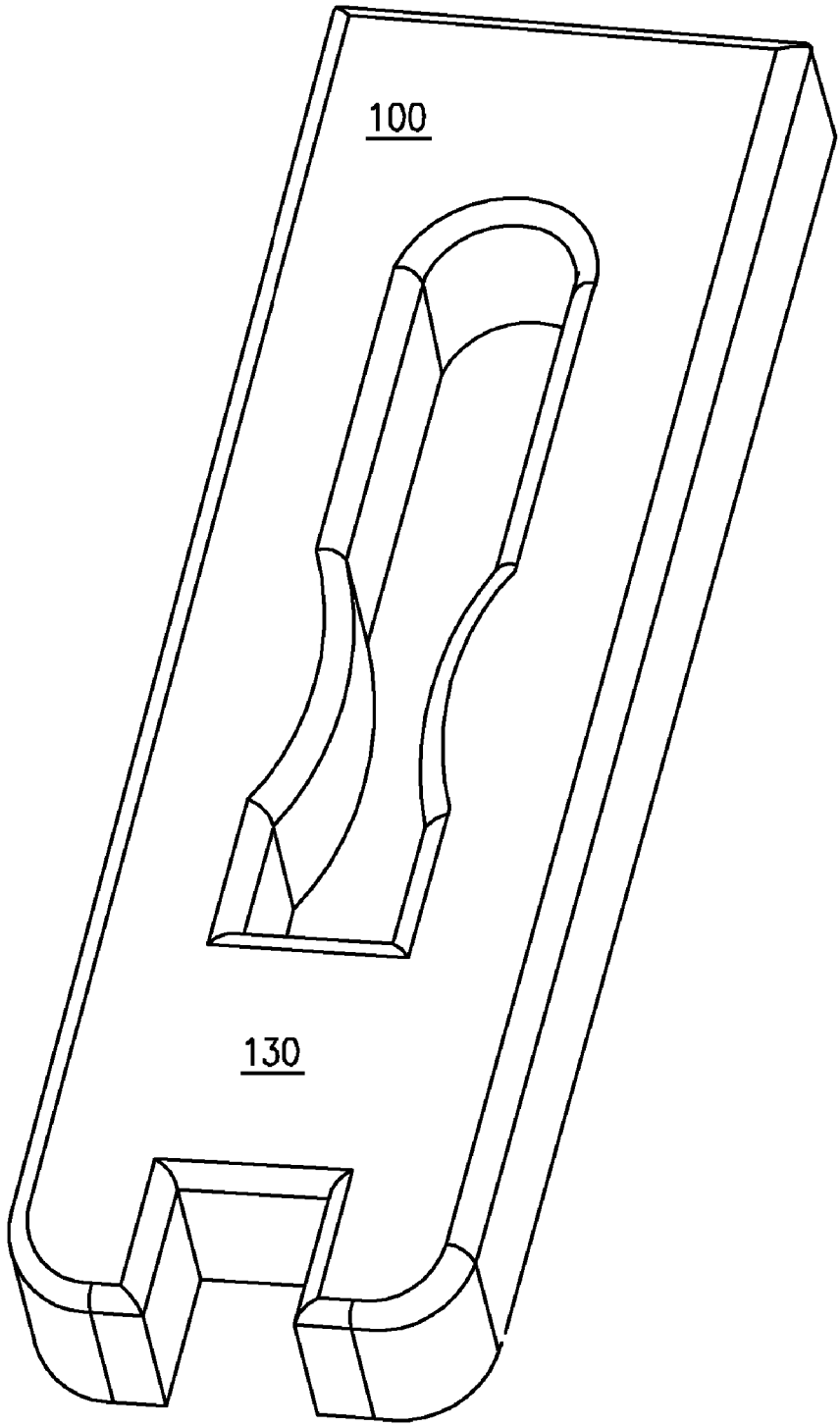
FIG. 10 is a perspective view of an electrical connector in accordance with one or more embodiments of the present invention.
Figure 11:
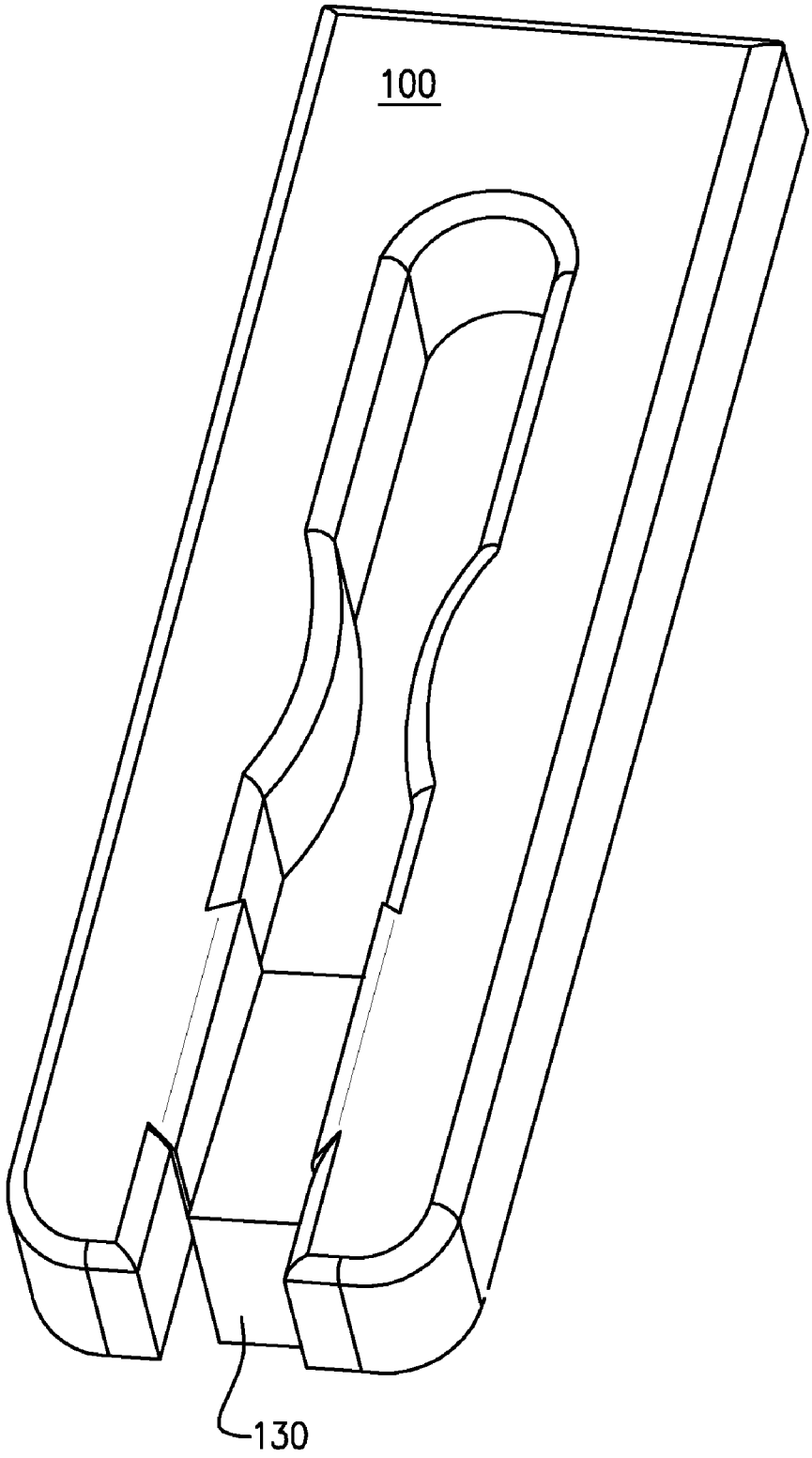
FIG. 11 is a perspective view of an electrical connector in accordance with one or more embodiments of the present invention.
Figure 12:
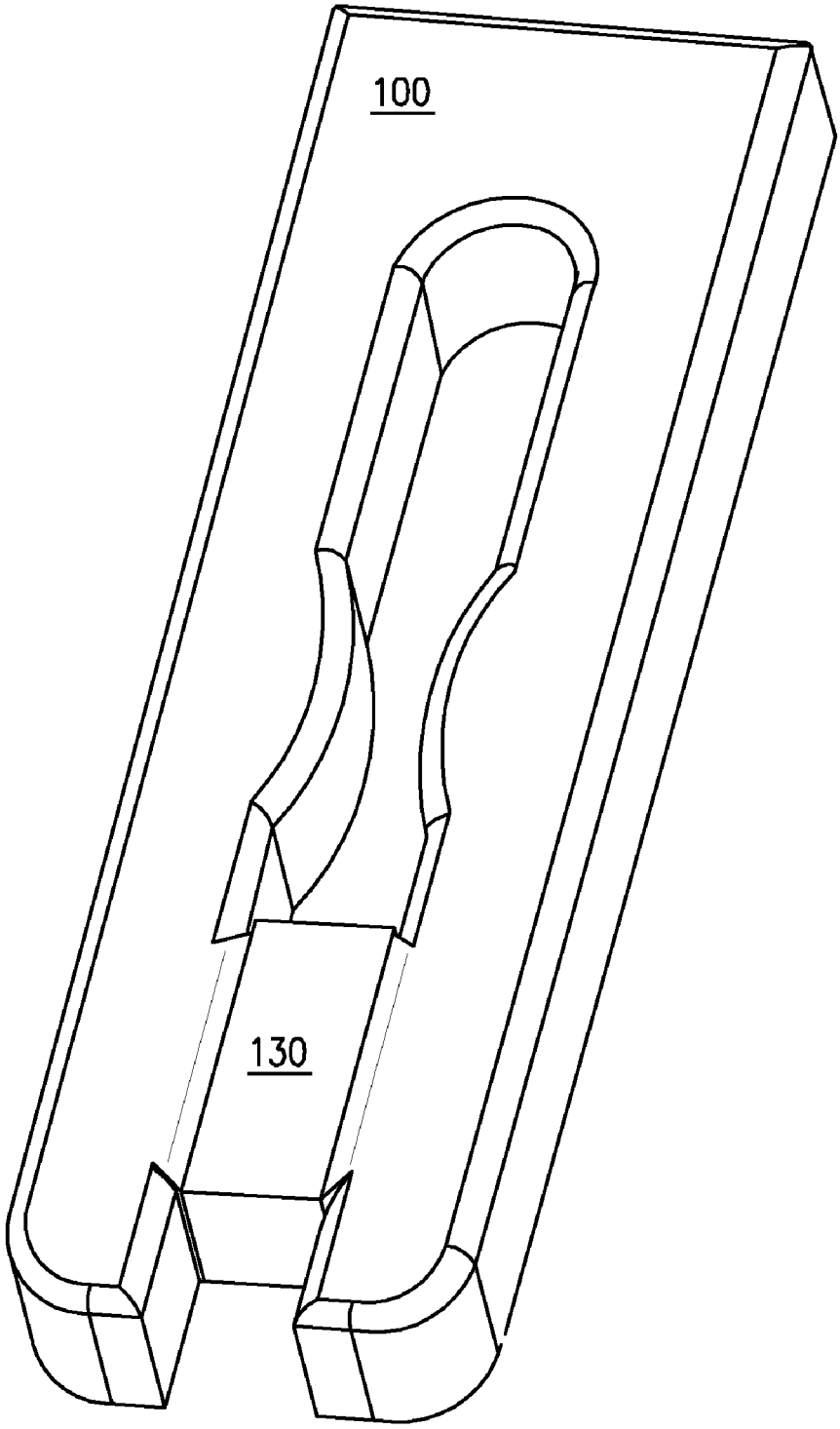
FIG. 12 is a perspective view of an electrical connector in accordance with one or more embodiments of the present invention.

FIGS. 10-13 show the process of producing and positioning the metal wedging slugs 130. The envisioned method of producing these slugs 130 is to stamp them using the same progressive punch and die arrangement that produces the entire connector. FIG. 10 shows connector 100 with the slug material prior to being punched or stamped. Referring to FIG. 11, the slugs 130 can be punched to at least partially separate them from the connector 100 body. It may sufficient for the punch to only cut deep enough to achieve a fracture. Then, referring to FIG. 12, the slug 130 is subsequently returned to its original position. Residual spring pressure and friction and other interferences hold the slugs 130 sufficiently securely until they are deliberately moved later in the assembly process.

Figure 13:
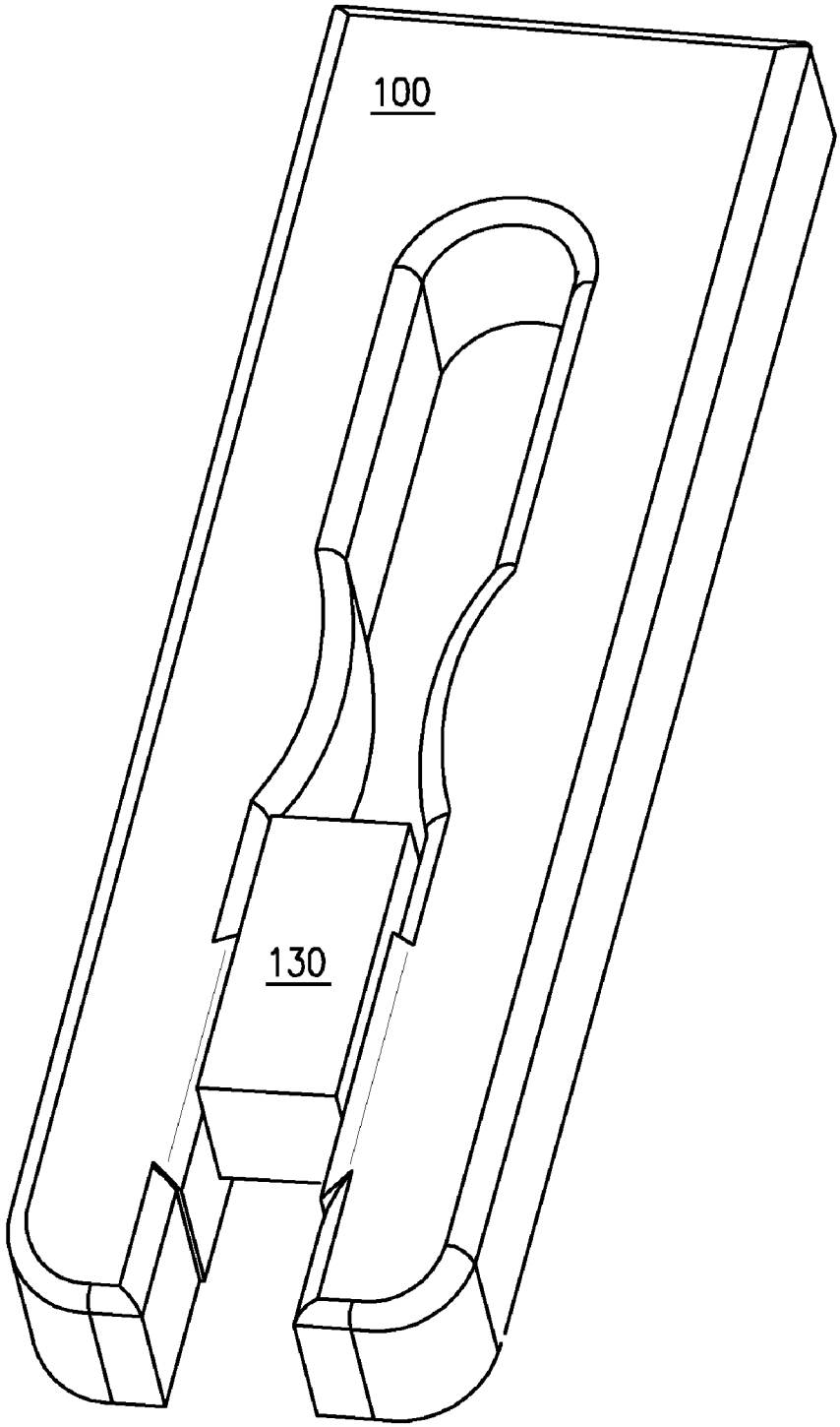
FIG. 13 is a perspective view of an electrical connector in accordance with one or more embodiments of the present invention.

In order to reduce the force needed to move the slugs 130 during assembly, with reference to FIG. 13, the progressive punch and die set can have mechanisms that break the friction bond to adjacent material and to preposition the slug 130, or otherwise stated, to move the slug 130 in the direction of subsequent assembly to be a ready for use as a wedge 130 within bobbin 200 to separate lances 110.

Figure 14:
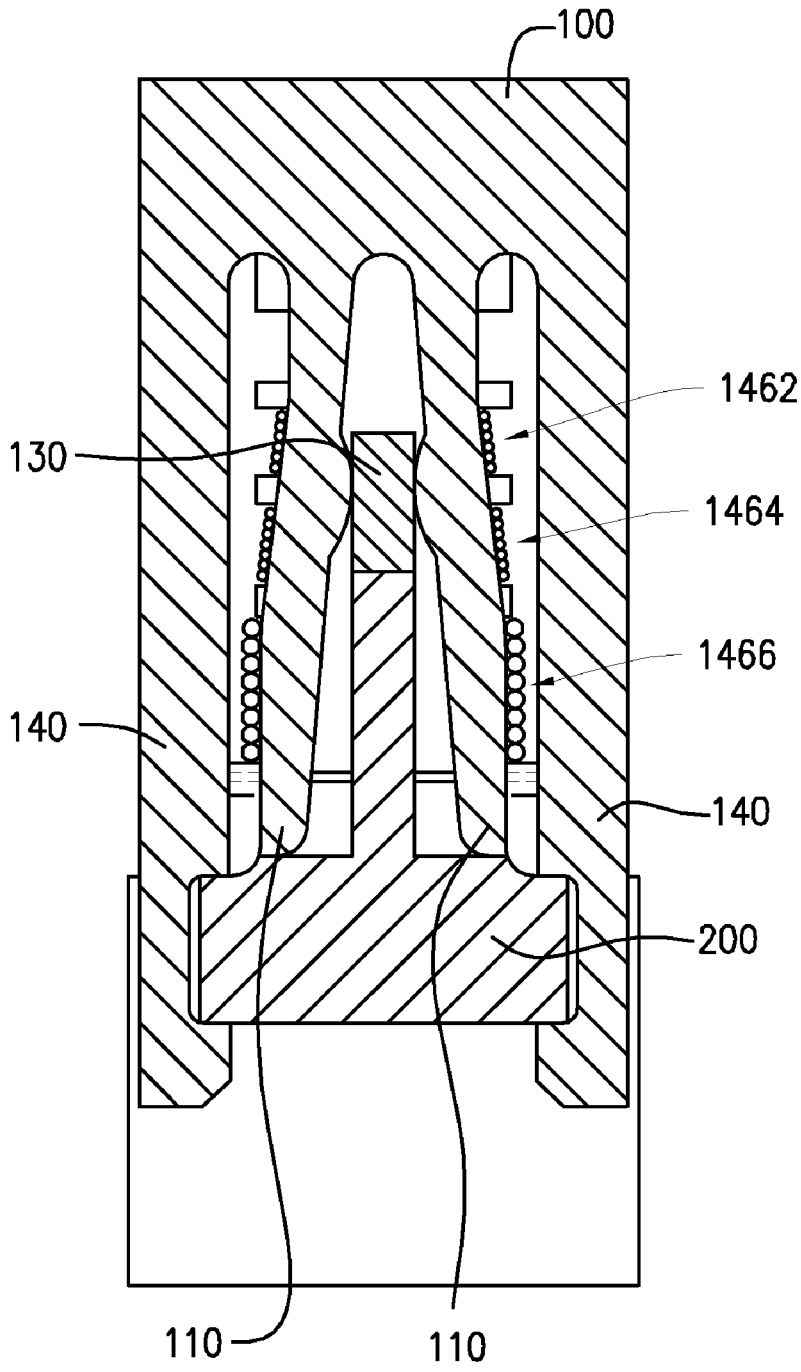
FIG. 14 is a front plan view of an electrical connector in accordance with an embodiment of the present invention.

FIG. 14, which provides a view similar to FIG. 8, shows the wedging and deflection of the lances 110 and springs 140. FIG. 14 shows wedge 130, connector 100 which includes lances 110 and springs 140, bobbin 200, fine wire zone 1462, medium wire zone 1464, and heavy wire zone 1466. A benefit of the embodiment of FIG. 14 is that once the wedging slugs 130 are in position, they are jammed and locked and do not need maintaining force from the material of the bobbin 200.

Figure 15:
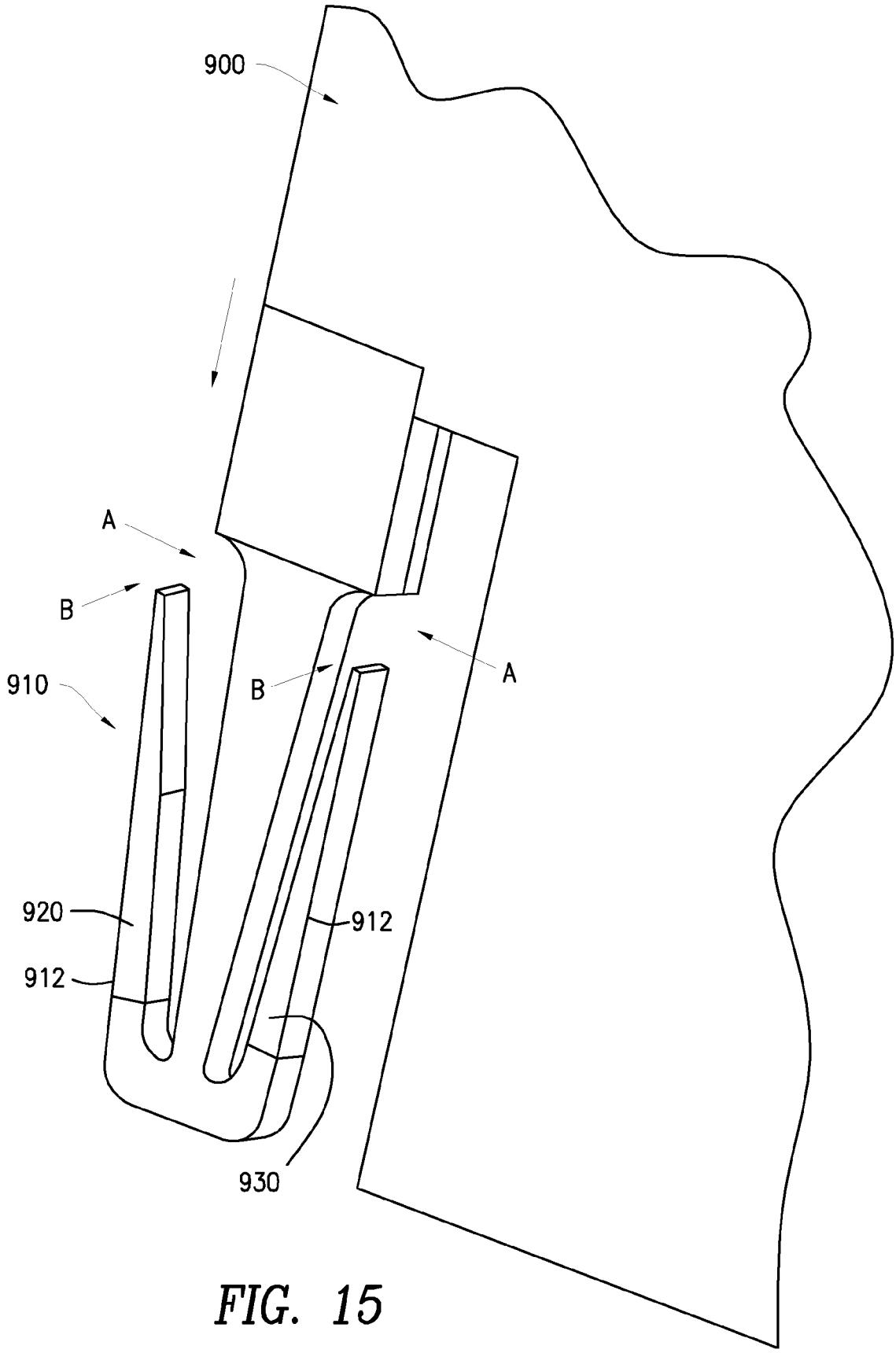
FIG. 15 is a perspective view of a part of a connector in accordance with one or more embodiments of the present invention.
Figure 16:
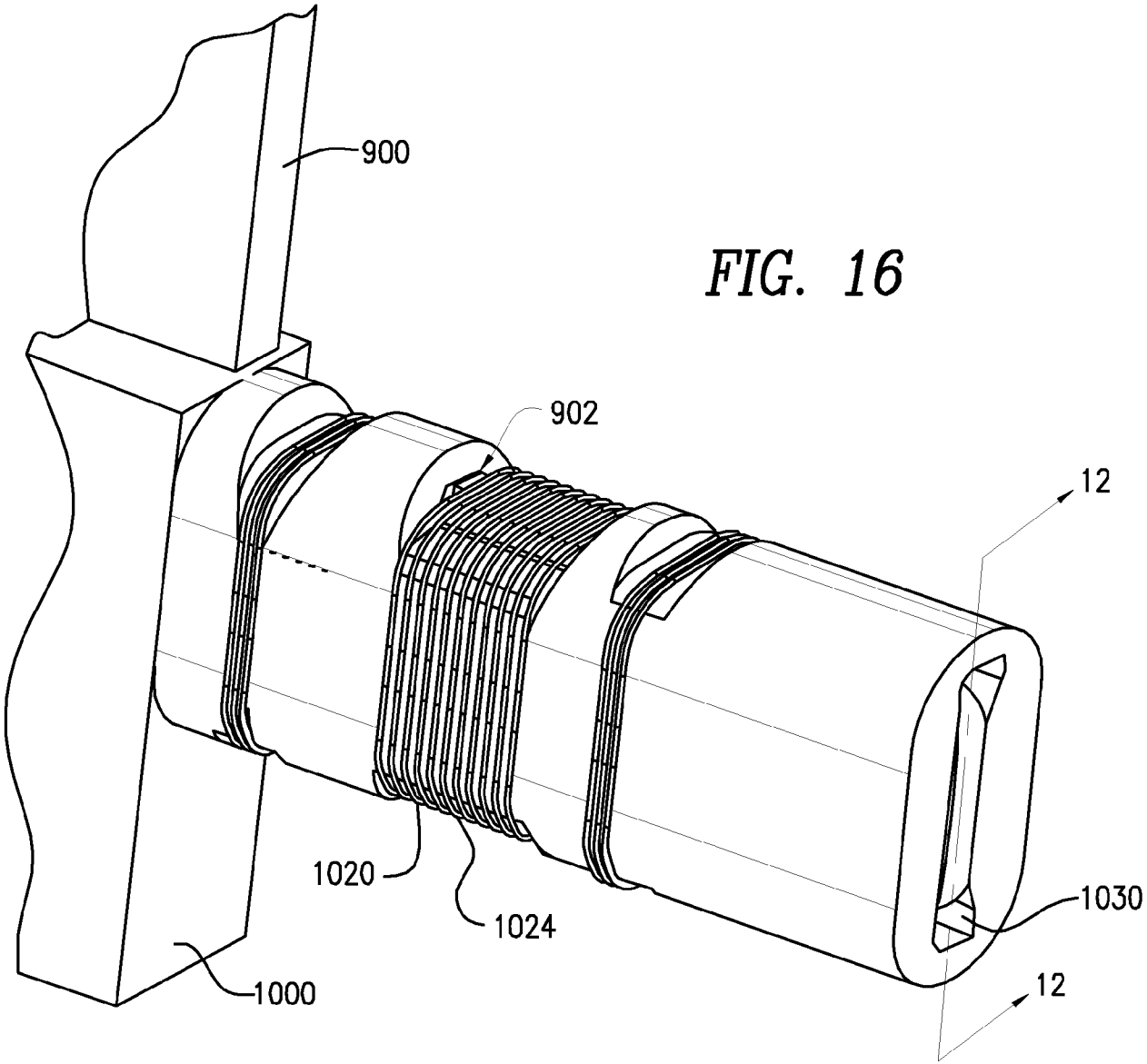
FIG. 16 is a perspective view of part of a bobbin and a winding anchoring in accordance with one or more embodiments of the present invention.
Figure 17:
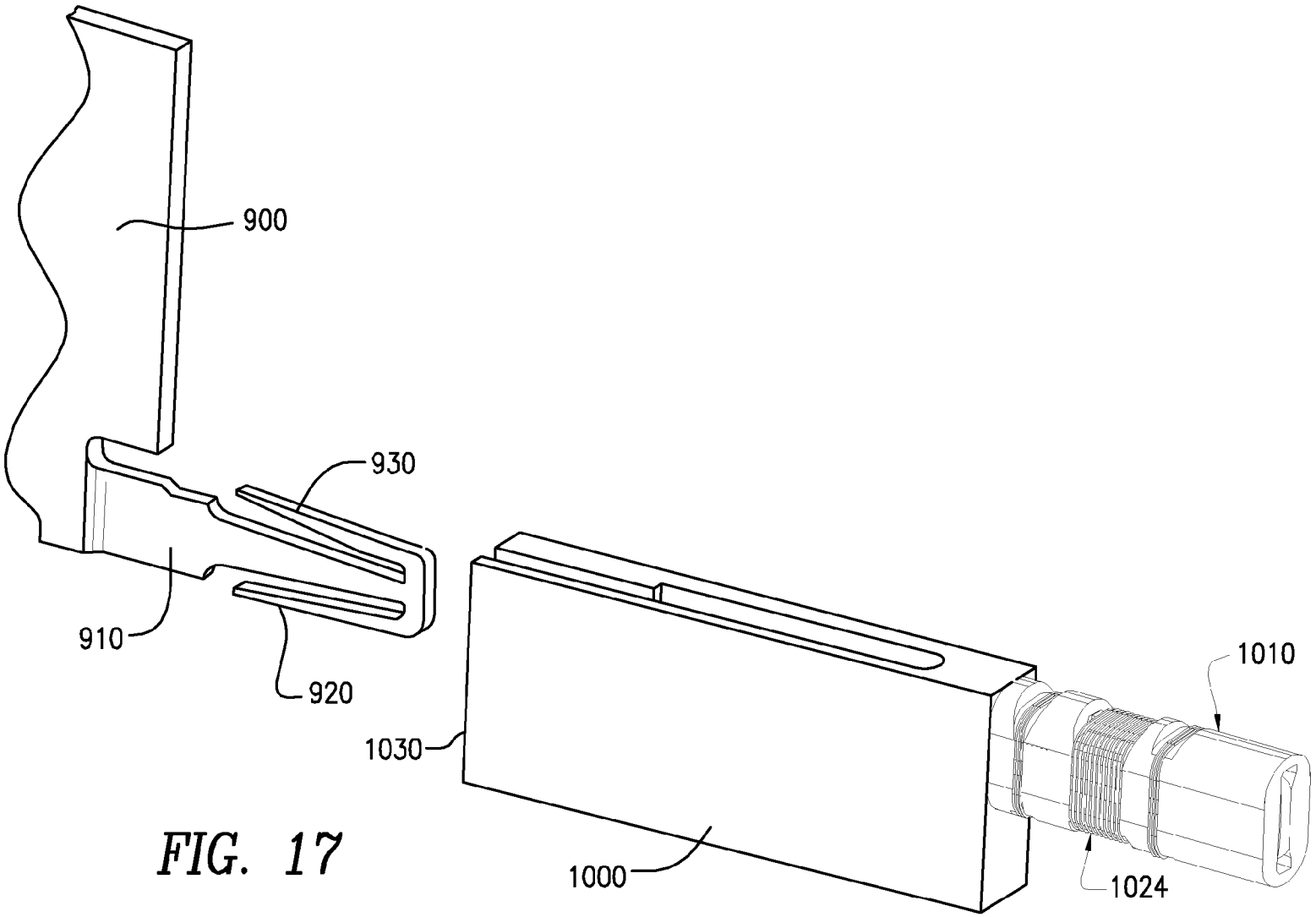
FIG. 17 is a perspective view of a connector adjacent to a bobbin in accordance with one or more embodiments of the present invention.
Figure 18:
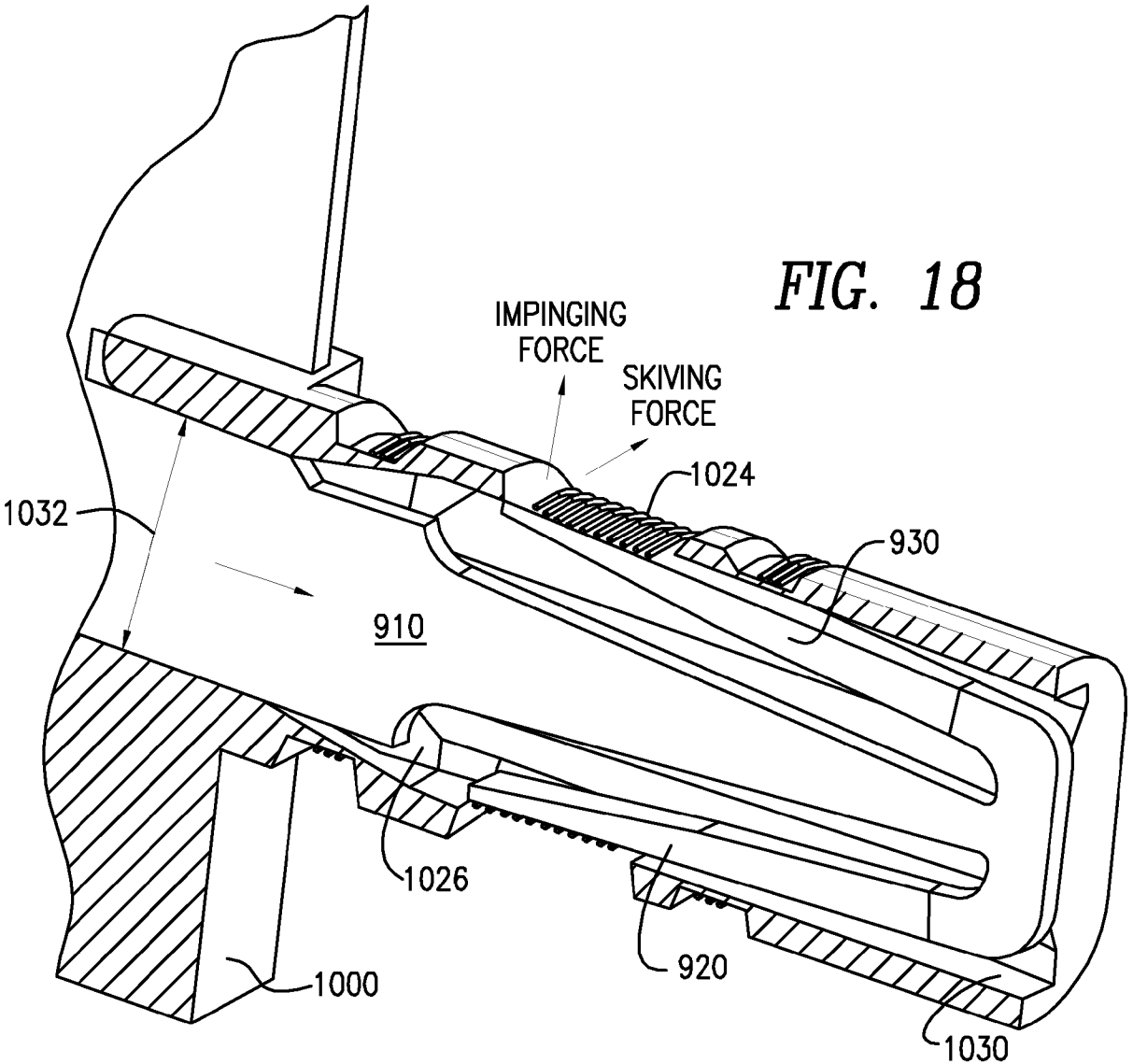
FIG. 18 is a sectioned perspective view of a connector assembled within a bobbin in accordance with one or more embodiments of the present invention.
Figure 19:
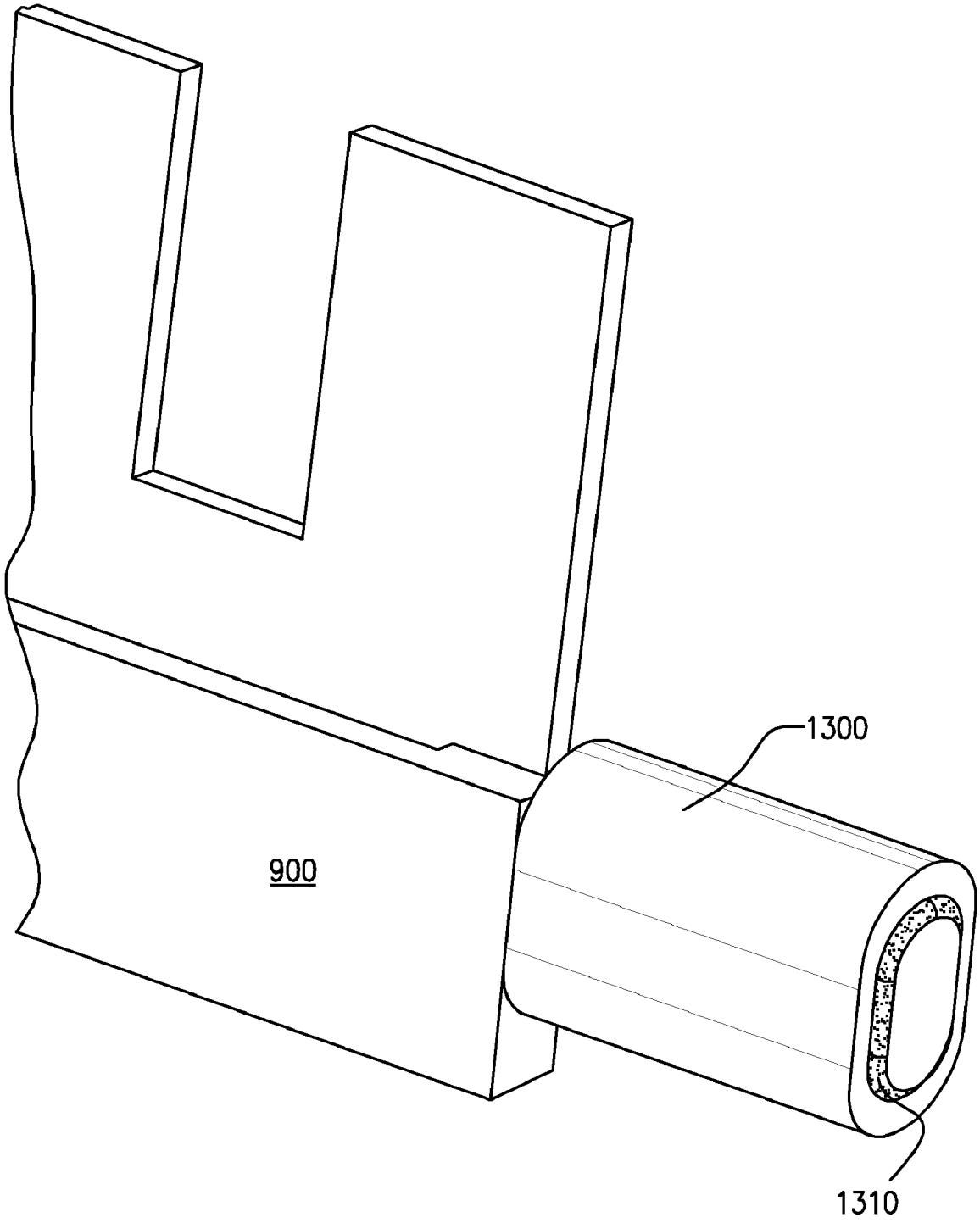
FIG. 19 is a perspective view of a finished connector to bobbin assembly in accordance with one or more embodiments of the present invention.

Attention is now directed to FIGS. 15-19 which depict one or more alternative embodiments of connectors, connector pins, bobbins, and wire wrap configurations. A brief description of the drawings is provided, followed by a more detailed discussion of the structure and operation of various parts depicted therein. FIG. 15 shows a part of a connector 900 in accordance with one or more embodiments of the present invention. FIG. 16 shows part of a bobbin 1000. FIG. 17 shows the connector 900 of FIG. 15 adjacent to the bobbin 1000 of FIG. 16. FIG. 18 shows a sectioned perspective view of connector 900 assembled within bobbin 1000 (shown along line 12-12 of FIG. 16). And, FIG. 19 shows a finished connector 900 to bobbin 1000 assembly.

In one or more embodiments, connector 900 may include connector pin 910 which may, in turn, include spring-loaded prongs (or "springs") 920 and 930 and edges 912. Bobbin 1000 may include anchor post 1010 and may have wire 1020 wrapped thereabout to form plurality of wire loops 1024. Shrink wrap sleeve 1300 (FIG. 19) may be sealed about bobbin 1000 and wire loops 1024. Adhesive layer or glue layer 1310 may be disposed between the interior of shrink wrap sleeve 1300 and the exterior of bobbin 1000 and, more particularly, of anchor post 1010.

In an embodiment, when a plurality of loops 1024 of wire 1020 are wound before the connector 900 is assembled into the bobbin 1000, the wire 1020 may be anchored at each end of bobbin 1000 by wrapping wire 1020 around one or more bobbin 1000 structures. Once wire 1020 is suitably anchored, connector 900 may be inserted into the bobbin structure 1000, thereby causing sharp-edged features 912 of each connector pin 910 impinge on, skive and make electrical contact with the wire loops 1024 that are wrapped around the anchoring structures. See FIGS. 16-17. The wire tension that is established for coil winding may be employed when wrapping wire 1020 onto the anchor structures 101 0. The wire tension level may affect the force equilibrium scheme once connector 900 impinges against the wire 1020 surface.

With reference to FIGS. 16-17, in one or more embodiments, anchoring structures, such as anchoring structure 1010, may accept multiple wraps 1024 of the coil wire 1020, while providing an internal passage or groove 1030 (FIG. 17) internally of the wire wrap that is configured to receive a connector lance (pin) 910 of connector 900, which may be introduced into structure 1010 of bobbin 1000 during an assembly operation. As connector pin 910 advances into bobbin 1000, pin 910 may impinge on and skive into the internal surfaces of the wire loops 1024, and establish conductive electrical contact between the metal of wire 1020 and pin 910. The connection may then be protected, sealed and locked by sealing a shrink wrap sleeve 1300 about anchoring structure 1010 of bobbin 1000 and wire loops 1024 (FIG. 19). A glue layer, or adhesive layer, 1310 may be disposed between shrink wrap sleeve 1300 and anchoring structure 1010. In selected embodiments, electrically conductive adhesive may be employed, which may include conductive particles dispersed within the adhesive layer 1310.

It is noted that while the above discussion is directed to embodiments in which pin 910 impinges on the interior surfaces of wire loops 1024 that are wrapped about bobbin 1000, in other embodiments, pin 910, or other structures may impinge on, skive, and establish conductive contact with other portions of wire loops 1024, including outer portions of loops 1024, whether along the exterior of the sides, top, or bottom of bobbin 1000.

In one or more embodiments, a bobbin, such as bobbin 1000, may include a surface that may be operable to push and deflect the contacting element of the connector 900 into impingement with the wire 1020. However, in contrast, one or more embodiments discussed below may involve having a preloaded element of the connector 910 being held back during assembly by a bobbin surface, possibly within bobbin groove 1030, and then released into spring-loaded contact with wire 1020 once the connector 900 is fully assembled. See FIGS. 15, 17, and 18.

FIG. 15 shows connector pin 910 of connector 900. While the following discussion is directed to embodiments in which spring-loaded prongs 910 are cantilevered springs, other mechanisms for biasing prongs 910 toward wire 1020 may be implemented, and all such variations are intended to be included within the scope of the present invention. In other embodiments, a single prong, spring or other device for biasing a connector pin portion against wire 1020 may be employed. In still other embodiments three or more springs or other biasing devices may be employed.

FIG. 15 depicts a pair of cantilevered springs (or, "spring-loaded prongs") 920 and 930 which may form a part of a connector pin 910 and connector 900. Prongs 920 and 930 are shown in their natural unstressed unloaded positions in FIG. 15. Each prong 920, 930 may be deflected in two directions. Deflection in the 'A' direction provides a reactionary force that may impinge against the surfaces of wire loops 1024. Further, deflection in the 'B' direction may be operable to cause a skiving motion along the longitudinal direction of the wire. Prongs 920, 930 can be preloaded inward along the "A" direction while within a portion of bobbin 1000.

FIG. 18 shows such a pair of cantilevered springs 920, 930 assembled into a bobbin structure 1000 making contact with wire loops 1024. Springs 920, 930 may be kept in a deflected state while moving through a constraining passage 1032 within 1030 of bobbin 1000 during assembly into the inner space of the wire wraps. Thereafter, one or more of prongs 920 and 930 may be controllably released so that a sharp edge 912 of the spring 920 or 930 may move in a first direction and thereby impinge against the surface of the wire 1020, which surface may include insulation material. Further, the spring 920 or 930 may be released to move in a second direction corresponding to the longitudinal direction of the wire 1020 so as to skive the insulation of wire 1020 and make electrical contact with the wire conductor 1020. The above-referenced controlled release of prongs 920, 930 may be enabled by the implementation of controlled spring release surfaces 1026 within groove 1030 of bobbin 1000.

Figure 20:
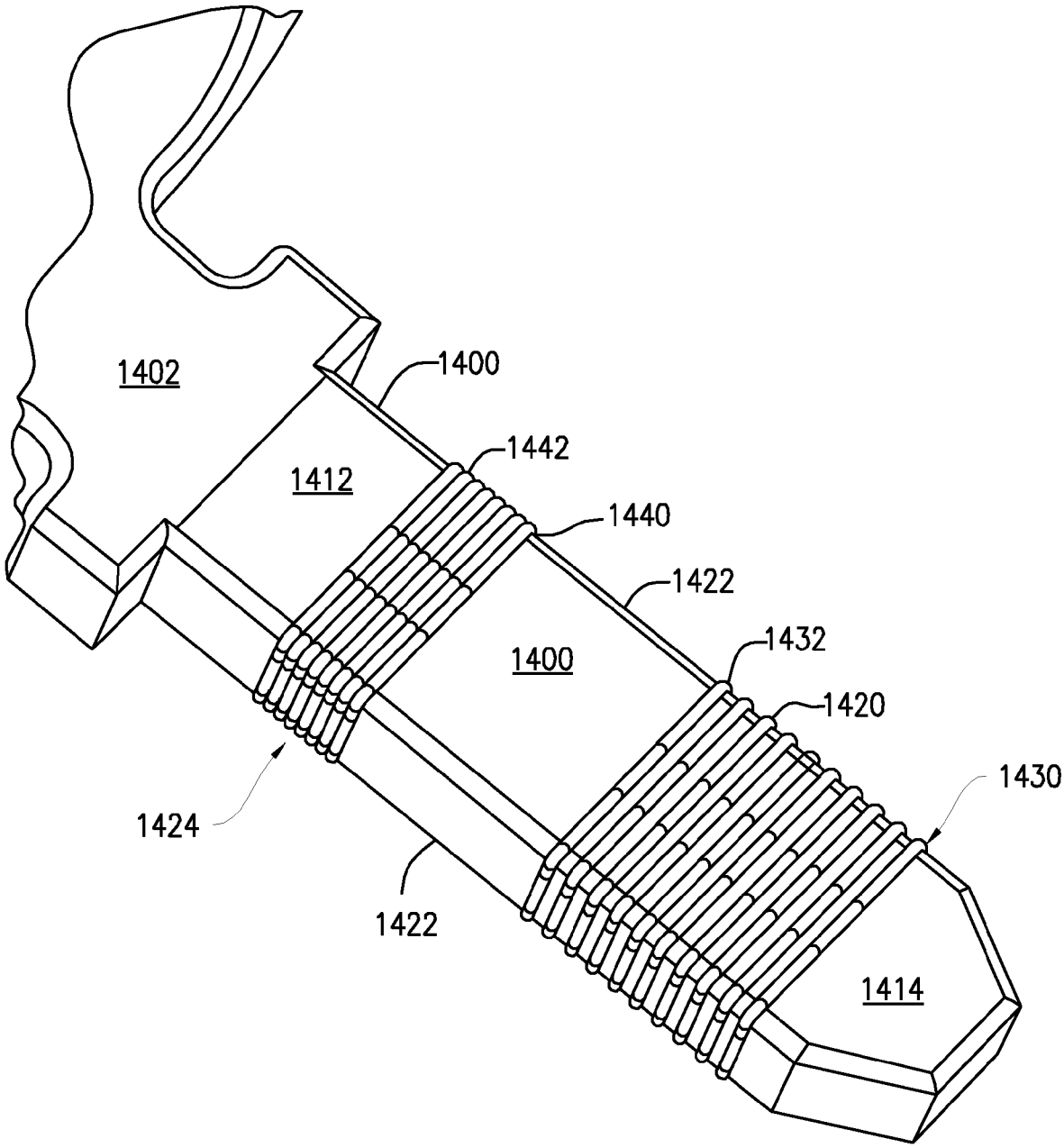
FIG. 20 is a perspective view of wire wrapping on a connector appendage in accordance with one or more embodiments of the present invention.

Now referring to FIG. 20, when a connector is assembled into a bobbin before the wire loop winding operation, one or more embodiments may provide a novel appendage (or "pin") 1400 of the connector onto which the end of the coil wire is wrapped a certain number of turns. These wraps of coil wire may serve to anchor the ends of the coil wire and to place the wraps in a position suitable for later manipulation, which may establish electrical contact between the coil wire and the connector 1402. This arrangement is discussed in greater detail below.

FIG. 20 shows wire wrapping on a connector appendage 1400 in accordance with one or more embodiments of the present invention. Appendage 1400 of a stamped connector 1402 is shown having a face in which the tip 1414 of the appendage may be thinner than the root 1412 of the appendage 1400. One end of the coil wire may be initially wrapped around appendage 1400 near its tip 1414. It may be difficult to precisely wind wire loops 1424 such that each loop is immediately adjacent to the next loop in succession of the wire loops 1424. Accordingly, it is expected that some small gap may exist between successive wire loops 1424. Such a gap between successive loops may be useful in that such gaps may provide means for achieving a natural gradient of wire tension within the wire loops 1424.

Note that the two sets of wire wraps shown in FIG. 20 do not co-exist but are alternative positions of a single set of wire wraps. Initially, the wire may be wrapped near to the tip 1414 and can occupy a space between wraps positioned at 1430 and 1432. In this position the tension in the wire is fairly constant as it is derived from the winding tension. The entire wrap set can then be slid along the appendage 1400 towards the root 1412 until it occupies a space defined by wrap positions 1440 and 1442.

During this movement, as the embodiment shown has a thicker root thickness, the wire wraps are compressed to be adjacent with each other and experience stretching, skiving and scraping contact with the connector appendage's sharp edges. The wire tension generally increases but, as the wrap initially at position 1430 moves further along the appendage to position 1440 than does the wrap initially at position 1432 which moves to position 1442, it is stretched more and therefore has more tensional stress. This produces a gradient tensile stress in the wire with the maximum stress being at the safest position most remote from the coil.

In accordance with at least one aspect of the present invention, contact may be established between appendage or "contact pin" 1400 and metal of wire 1420 in many places along the wire 1420. This approach may provide protective redundancy in that, if some appendage-wire contact areas fail, other contacts that are performing well, may serve as a backup.

Figure 26:
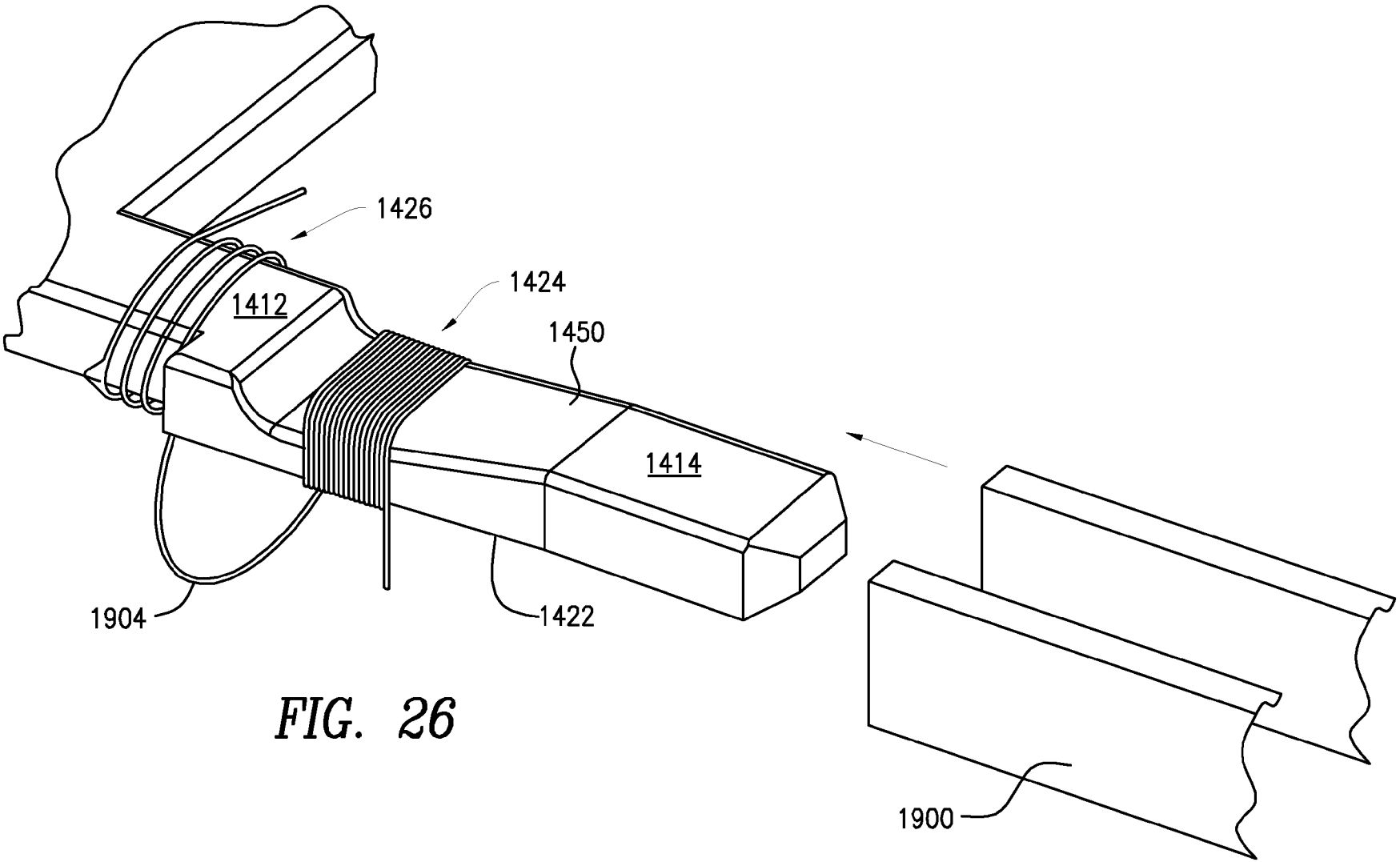
FIG. 26 is a perspective drawing of a connector appendage with wire wraps about the perimeter thereof, in accordance with one or more embodiments of the invention.

However, with reference to FIG. 26, if a break occurs in wire 1420 close to coil connection 1428, all of the contacts further away from the coil than coil connection 1428 may be lost and the coil may fail. However, if the wire 1420 should break at a point that is distant from the coil connection 1428, then contact points closer to the coil than the point of contact failure may still be functional, and the coil may remain sound.

Herein, the term "coil" refers to a length of coil wire that is wound around a bobbin. This coil may contain many thousands of turns and serves to convert electrical energy into mechanical energy and movement, such as in a solenoid operating a valve or a power contactor.

A natural tension gradient may result from the magnitude of the linear gap or distance between neighboring wire loops 1424 on appendage 1400. In some embodiments, this fact may be beneficially exploited. The wire loops 1424 may be placed at a high end of the tension gradient, such as at 1902 in FIG. 25, remote from the coil, thereby creating a natural safety device.

Wire tension may be operable to apply the force that causes the devices of one or more embodiments of the present invention to function. However, the wire 1420 tension should preferably stay well below breaking tension. Therefore, suitably controlling the tension in wire 1420 may be beneficial for the operation of the embodiments disclosed herein.

The final resulting tension, or overall tension, in wire 1420 may be the result of at least four major contributions. The final resulting wire 1420 tension may be controlled by adjusting one or more of these four contributions.

A first contribution to the overall tension, is the initial tension with which wire 1420 is wound by a winding machine, in a fully automatic winding operation, or by the feel and skill of a human operator in a semi-automatic manual anchoring operation. A second contribution may arise from the helical pitch of the initial wrapping operations, as set by the action of a wire guide in a computer-controlled winding machine or by the operator in a manual anchoring operation. A third contribution may arise from the change in cross section of the appendage 1400 along which the wire loops 1424 are moved and compressed. The magnitude of this third contribution may fixed by the design of the appendage 1400. A fourth contribution to the final wire tension may be a function of the distance that the wire loops 1424 are moved along the length of the appendage 1400. This distance may be determined a design of the assembly process and/or of the assembly equipment.

It is noted that the shape of the appendage 1400 may be adjusted and fixed by the design and manufacture of the connector 1402, and may not be adjustable at the time of the winding operation. Therefore, the initial tension setting and the helical pitch adjustment may be the only variables that can be controlled at the time of the wire 1420 winding operation. After completing the winding (wire wrapping) operation, the length of the wrap pusher 1900 (FIG. 26) stroke is another controllable factor which may contribute to the final wire tension.

In some embodiments, one or more mechanisms for setting an initial tension for wire 1420 may be provided such as an adjustable spring, weight, and/or gas/fluid loaded dancer arm. This tension may be conveniently used for wrapping wire 1420 about the anchoring appendages.

In some cases, computer controls may be employed to increase or decrease the wire tension at one or more anchoring points. For example, the wire 1420 tension may be reduced when wrapping strain relief loops 1426, and may be increased upon wrapping the main, more tightly tensioned wire loops 1902, which are also denoted herein by reference numeral 1424.

The helical pitch of the wire loop 1424 contact wrapping may have the effect of reducing the final wire 1420 tension. A widely spaced helical pitch may produce a relatively low final wire 1420 wrap tension after the wire loops 1424 are pushed along the length of the appendage, since the wire loops 1424 may be loosened considerably by being forced closer together. In contrast, a closely spaced helical pitch may not cause the wire 1420 tension to decrease as the wire loops 1424 are pushed along appendage 1440 by wrap pusher 1900.

Once a suitable wire 1420 tension is in place, wire 1420 may then be moved relative to the sharp edges 1422 of the connector appendage 1400. The movement of the wire 1420 against the sharp edges 1422 of appendage 1400 may skive the insulation, thereby operating to establish conductive electrical contact between the conductor metal of wire 1420 and the appendage, or connector pin 1400. In one or more embodiments, such as where the wire loops 1424 are quite close together prior to the skiving action, the skiving action may be completed without significantly reducing the tension in wire 1420.

Figure 21:
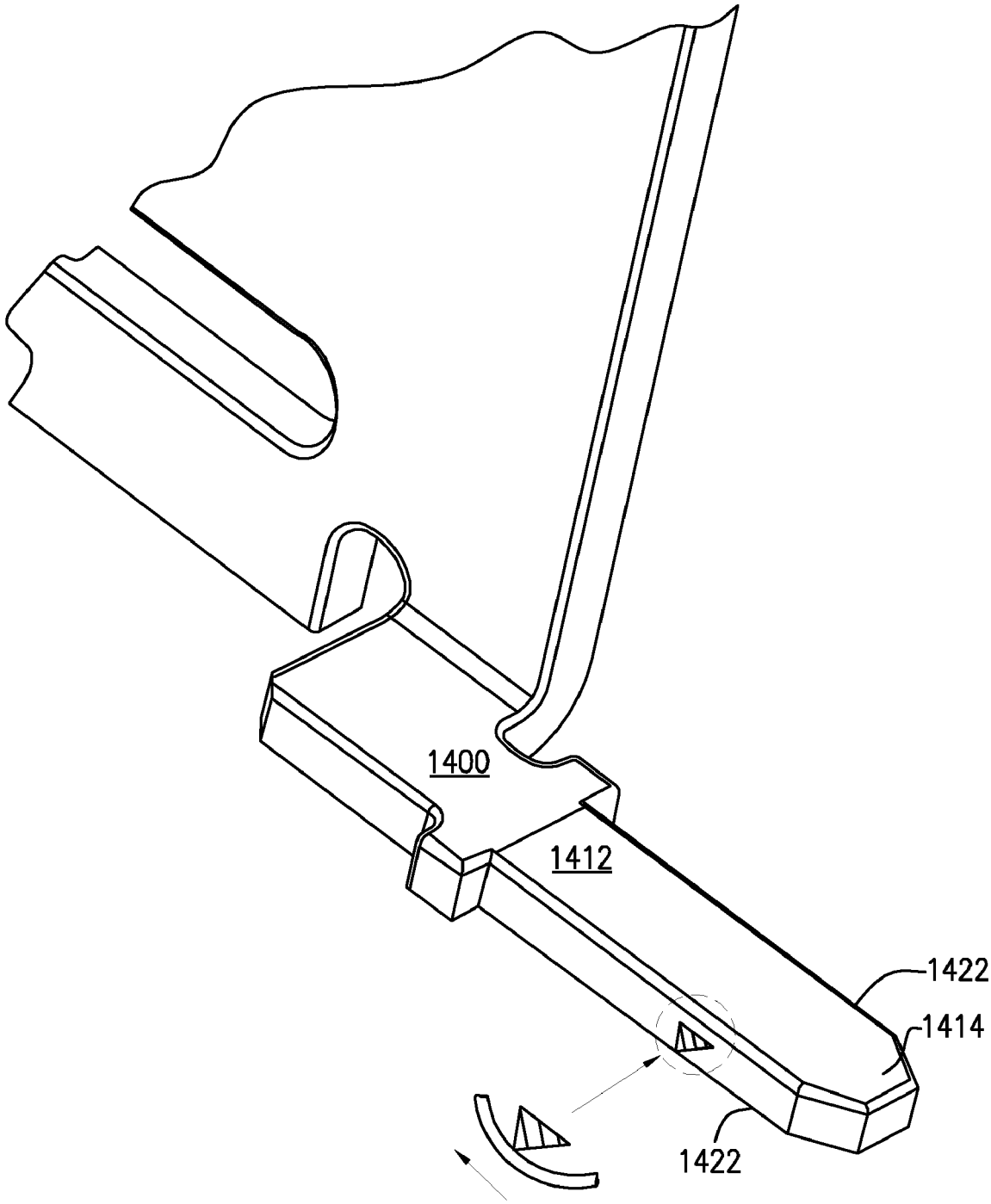
FIG. 21 is a perspective drawing of a connector appendage showing wire movement with respect to the appendage in accordance with one or more embodiments of the present invention.
Figure 22:
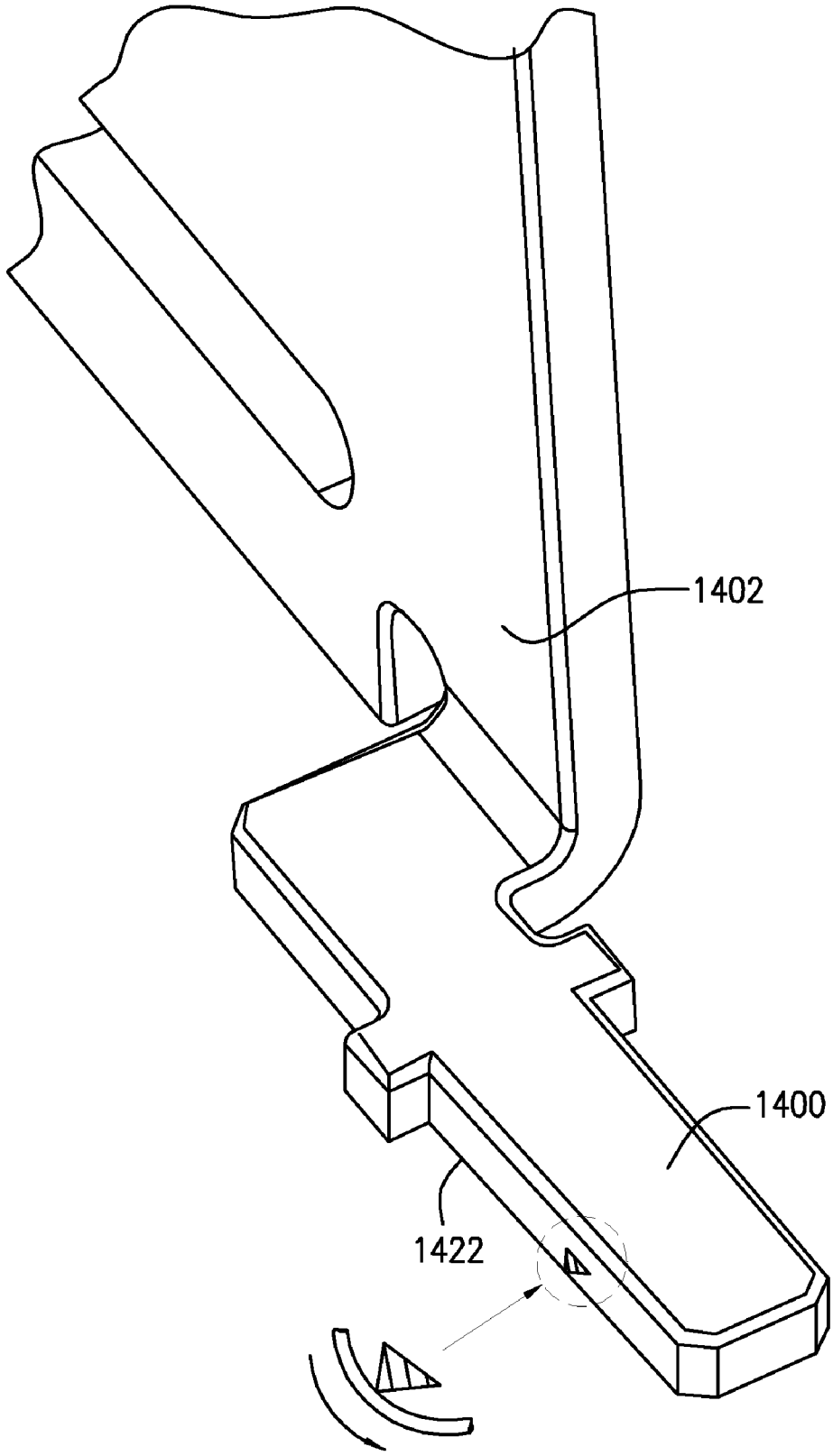
FIG. 22 is a perspective drawing of a connector appendage in accordance with one or more alternative embodiments of the present invention.

FIG. 21 illustrates one possible direction of wire 1420 movement with respect to corner or edge 1422 of appendage 1400, as wire loops 1424 are pushed along an appendage 1400, in which the sides of appendage 1400 are parallel, and the top surface of appendage 1440 is tapered with respect to a longitudinal axis of appendage 1400. FIG. 22 illustrates one possible direction of wire 1420 movement with respect to corner or edge 1422 as wire loops 1424 are pushed along an appendage 1400, in which the top and bottom surfaces of appendage 1400 are parallel, and the sides of appendage 1440 are tapered with respect to a longitudinal axis of appendage 1400. In the cases of both FIG. 21 and FIG. 22, the illustrated skiving action may operate to cut through insulation coating the metal portion of wire 1420 to aid in establishing conductive electrical contact between appendage 1400 and the metal of wire 1420.

Figure 23:
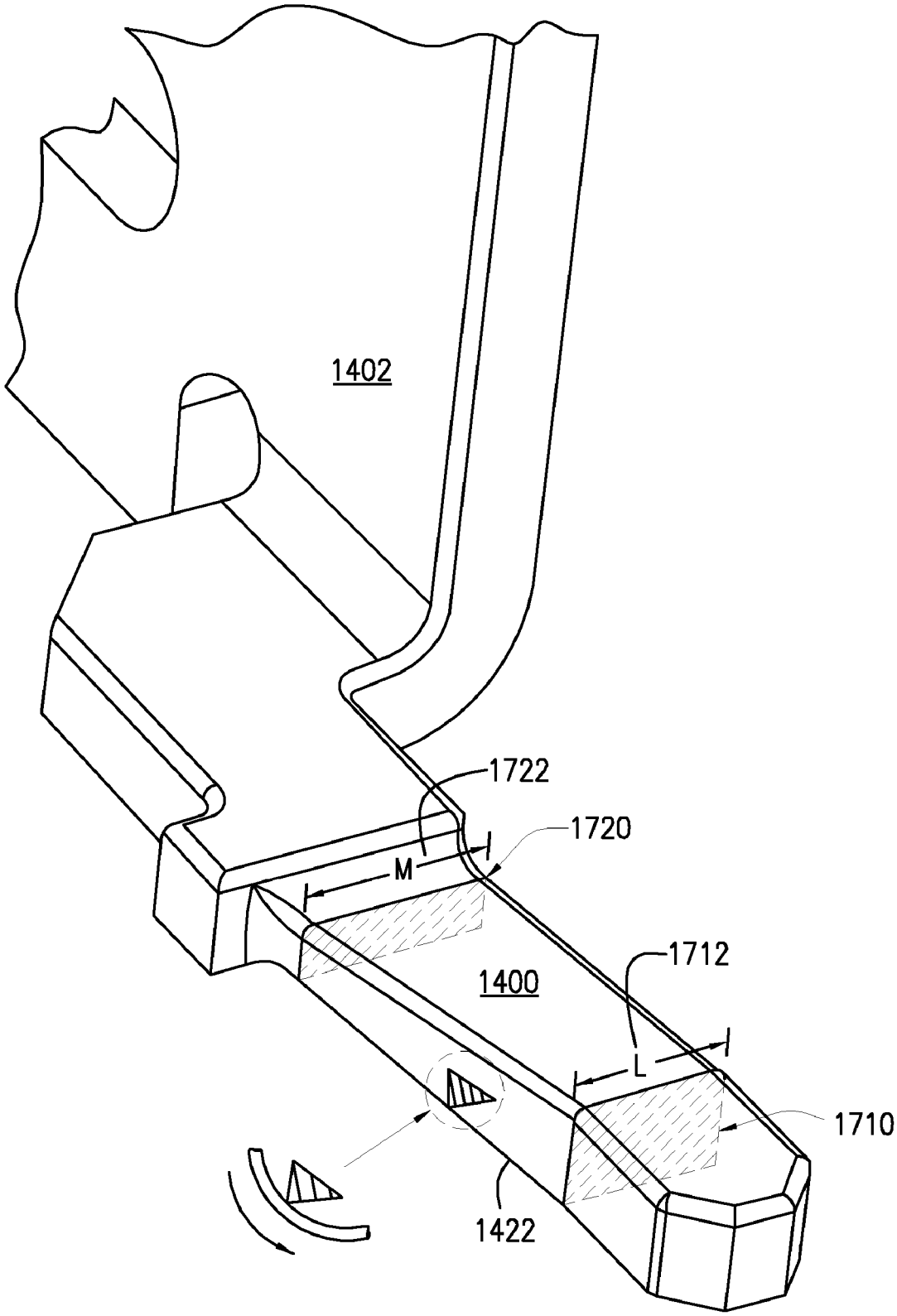
FIG. 23 is a perspective drawing of a connector appendage having varying cross-sectional geometry, in accordance with one or more alternative embodiments of the present invention.

FIG. 23 shows an embodiment of appendage 1400 of a stamped connector 1402. Cross-section 1710 may have a given perimeter. Cross-section 1720 may have a perimeter that can be adjusted to equal that of cross-section 1710, or to equal another value representing some defined ratio with respect to cross section 1710 that is either above or below 1:1. A length of a given single loop wire 1420 may be defined by wrapping the wire 1420 about the appendage 1400 at or near the perimeter of cross-section 1710. Thus, if the given loop of wire is moved along the appendage 1400 to, or near, the perimeter of cross-section 1720, the wire tension may change based on the relative magnitudes of the two perimeters, or circumferences 1710, 1720. If the perimeters are equal, then the tensions of the given loop of wire at the two respective locations may also be equal. If, for instance, the ratio of the perimeter at 1720 to the perimeter at 1710 is 1.05:1, then the ratio of the corresponding tension may also be 1.05:1.

In FIG. 23, the lengths 1712 and 1722 (as well as the thicknesses) of cross sectional areas 1710 and 1720, respectively, are shown as being quite different. For example, length 1712 could be set to equal 0.060 inches, while the length 1722 at cross-section 1720 is set to 0.076 inches. In this case, movement of the wire loop from cross-section 1710 to cross-section 1720, a total of 0.016 inches of wire material may slide past the sharp edges 1422 of the appendage 1400. In this way, a relatively large skiving length can be made on a wire 1420 with little effect on tension. The direction of wire 1420 motion about edge 1422 is shown in the blow-up image at the lower left of FIG. 23 As will be apparent to one skilled in the art, the shape shown in FIG. 23 is not the only shape that will achieve this controlled tension effect while skiving the insulation and making electrical contact between the appendage 1400 and the wire 1420.

Figure 24:
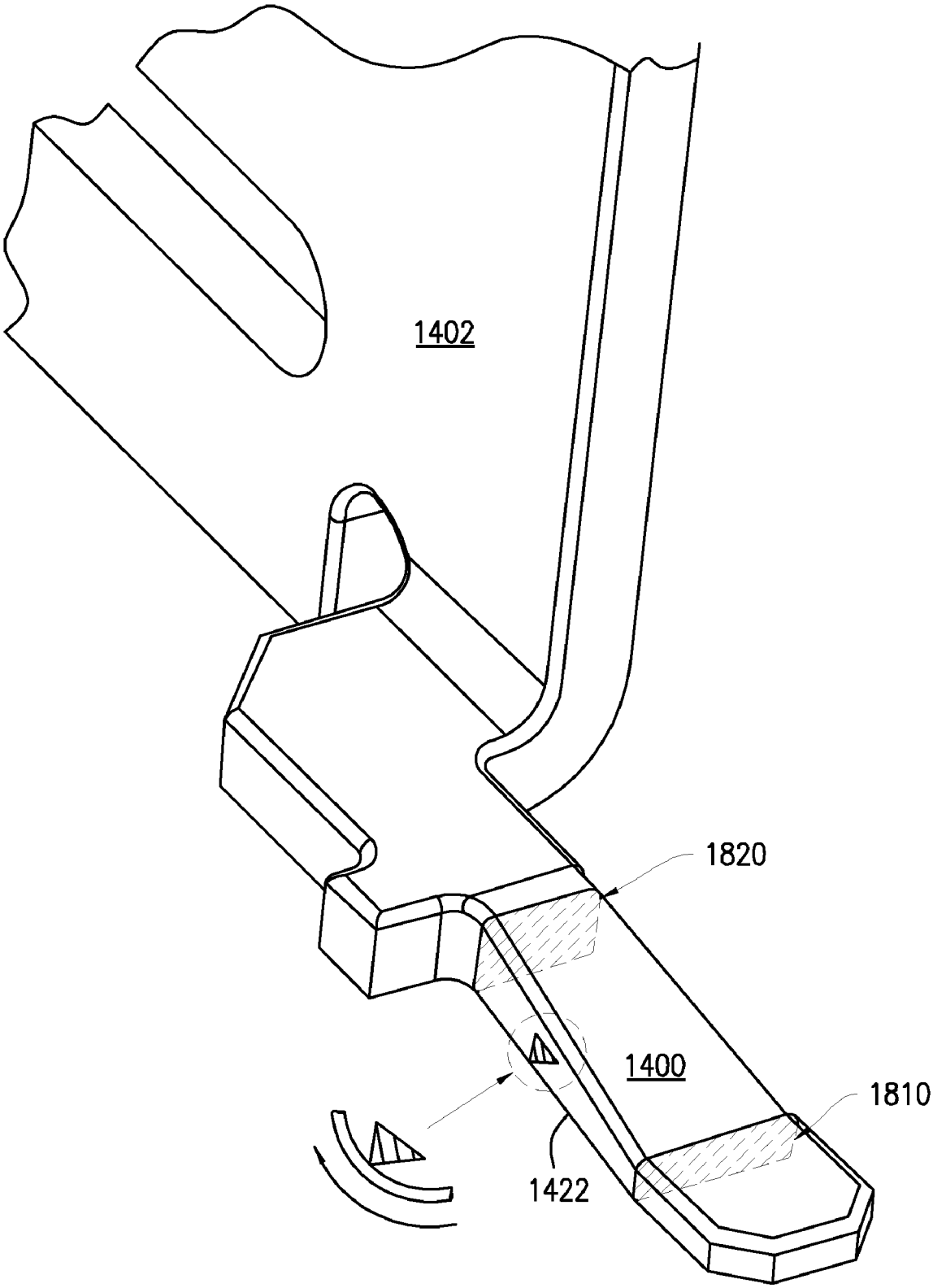
FIG. 24 is a perspective drawing of a connector appendage having varying cross-sectional geometry, in accordance with one or more alternative embodiments of the present invention.

FIG. 24 shows a connector appendage 1400 in which the direction of change in the appendage circumference as a function of location along appendage 1440 is reversed. Again, the wire tension that will result from pushing a wire loop from location 1810 to location 1820 on appendage 1400 may depend on the perimeters of the cross-sections at locations 1810 and 1820, respectively. Moreover, the direction in which the wire 1420 may skive across the sharp edges 1422 may be reversed. The direction of wire 1420 motion with respect to edge 1422 is shown in the blow-up image at the lower left of FIG. 24.

During the stamping of the connector 1402, the sharp edges 1422 may be produced by the sudden fracture of the material at the die side. There is typically a small burr protruding in the direction of the punch motion at a sharp edge 1422.

The selection of either a shape shown in FIG. 23, or a shape shown in FIG. 24, may operate to control the direction of the wire 1420 motion over edges 1422. In the embodiment of FIG. 23, the wire 1420 may move with the burr direction. In the embodiment of FIG. 24, wire 1420 may move against the burr direction. Thus, this ability to control skiving direction with respect to the burr direction may enable control over the severity, or extent, of the skiving. This is because moving wire against the burr direction may operate to cut or skive more deeply then moving wire with the burr direction.

More robust wires, such as wires over 34AWG, do not normally require the tension control that the particular appendage 1400 shapes of FIGS. 23 and 24 provide. When using such robust wires, the higher tension and the movement of the wire loops 1424 along the appendage 1400 may pierce the wire 1420 insulation and may make contact with the conductor of the wire 1420 whether the appendage 1400 is tapered or parallel. This method can be applied to wires finer than 34 AWG if the force pushing the wire loops 1424 along the appendage 1400 is limited.

When using wires finer than 42 AWG, the tip 1414 (e.g. FIG. 20) of the appendage 1400 may be thinned slightly (by approximately 0.002"). This slight change in cross-section may be sufficient to increase the tension as the wire loops are moved along the appendage, toward root 1412, to the larger cross-sectional locations. FIGS. 20-22 show appendages 1400 with very slight changes in cross-sectional area along their lengths. These small changes may still create movement of the wire around the corners 1422, as the wire loops 1424 are pushed along the appendage 1400.

Various other configurations of the appendage 1440 may enable penetrating the insulation of wire 1420 while moving wire 1420 along the length of the appendage 1400. All these possible configurations would be within the spirit and purpose of the present invention.

A method for manipulating the wire loops 1424 to make electrical contact between the wire 1420 and the appendage 1400 is described below. In some embodiments, the appendage 1400 and wire loops may be insulated, protected, and/or sealed to finish the connection and enable appendage 1400 with wire loops 1424 thereon to be effectively preserved.

Figure 25:
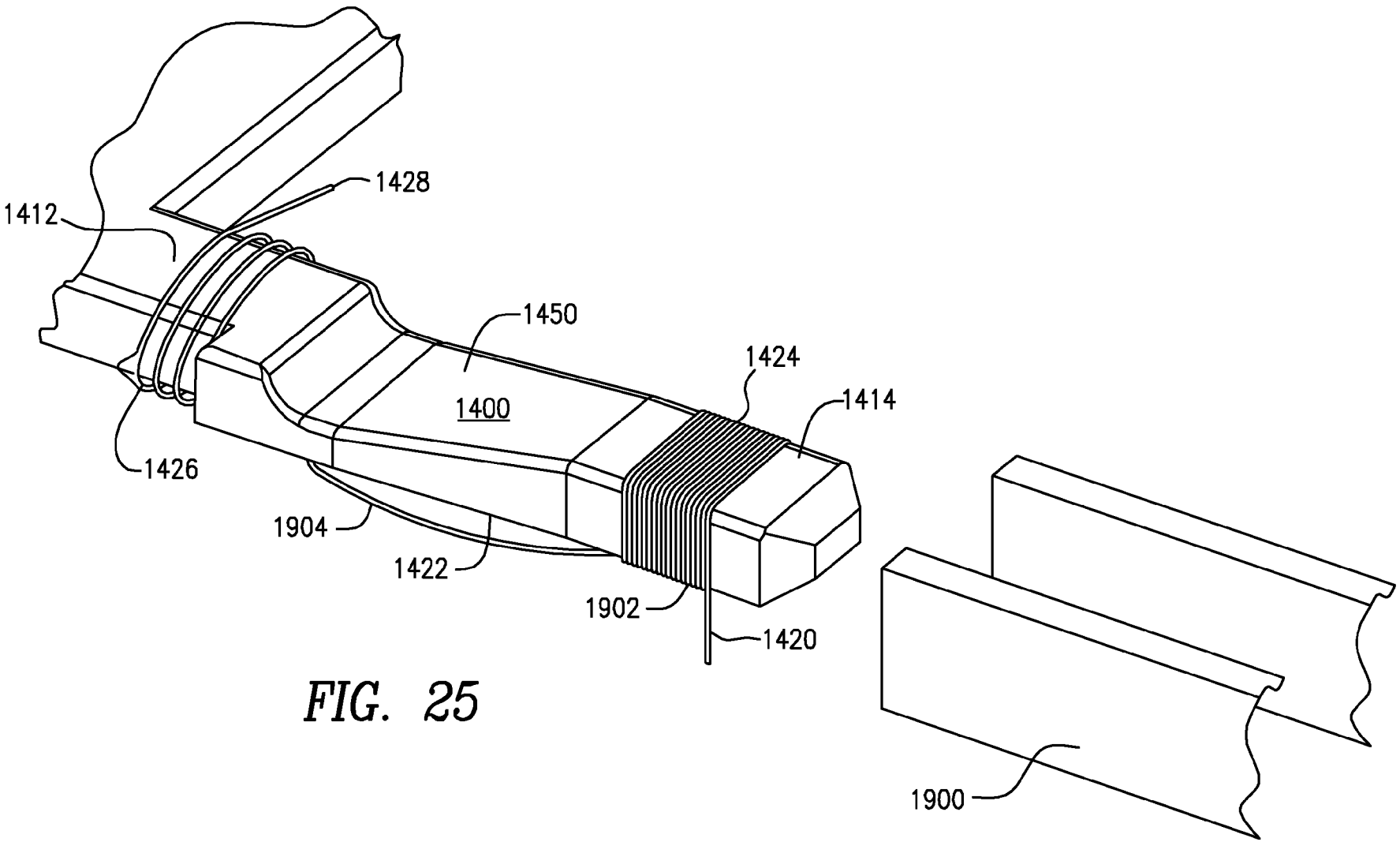
FIG. 25 is a perspective drawing of a connector appendage with wire wraps about the perimeter thereof, in accordance with one or more embodiments of the present invention.

Attention is directed to FIG. 25, which shows a connector appendage 1400 which includes wire loops at a start 1902 of the coil winding at which location wire loops 1424 may be tightly tensioned. Following the path of the wire 1420 that is wound around the appendage 1400, the wire 1420 is seen to wrap around the end of the appendage with at least one loop 1904, which extends through the constant-section perimeter zone 1450. It is noted that the maximum number of loops may be limited by the space available on a wrapping portion of the appendage 1400.

The wire 1420 may then form various loops 1426 around a portion of the appendage 1400 at its root 1412, to provide strain relief. The wire 1420 may then be coupled 1428 onto the main winding of the coil. A portion at the tip 1414 of the appendage 1400 may not be wrapped. This portion may be used to guide the wrap pusher 1900 the operation of which is described below. A similar, but reversed wrapping scheme is used at the end of the coil winding. At the end of the winding, the wire first wraps around the strain relieving portion 1426 then around the contact portion 1902, ending towards the tip 1414 of appendage 1400.

In one or more embodiments, the above-discussed wire 1420 wrapping schemes, in combination with the selected particular shapes of the appendage 1400, may operate to stretch the wire loops 1424 that are farthest from the coil more than those near the coil. In this way, if a fracture occurs, it may be located at a harmless point, that is distant from the coil. Such a fracture may not defeat overall operation of the wound appendage 1400, as sufficient contact points may remain intact to enable sufficient current flow through wire loops 1424 that are still operational.

With reference to FIG. 26, after the winding of wire 1420 is complete, the wound appendage 1400 may be transferred to a further operation where the starting and finishing coil connections are made. Each group of wire loops 1424 near the tip 1414 of each appendage 1400 may be pushed along the appendage 1400 towards the root 1412 of the appendage 1400. Wire loops 1424 may be pushed by wrap pusher 1900 along appendage 1400 to the constant section perimeter zone 1450. As part of the pushing process, interior surfaces of the bottom portions of the wire loops 1424 may undergo the cutting and skiving process discussed earlier. Specifically, the pushing process causes wire 1420 insulation to be skived away by appendage edges 1422, and thereby causes the conductor metal of wire 1420 to make conductive contact with appendage 1400. Preferably, because of the cross-sectional geometry of this embodiment of appendage 1400, wire loops 1424 are not stretched, or at least not stretched excessively, while being pushed toward root 1412 of appendage 1400.

Figure 27:
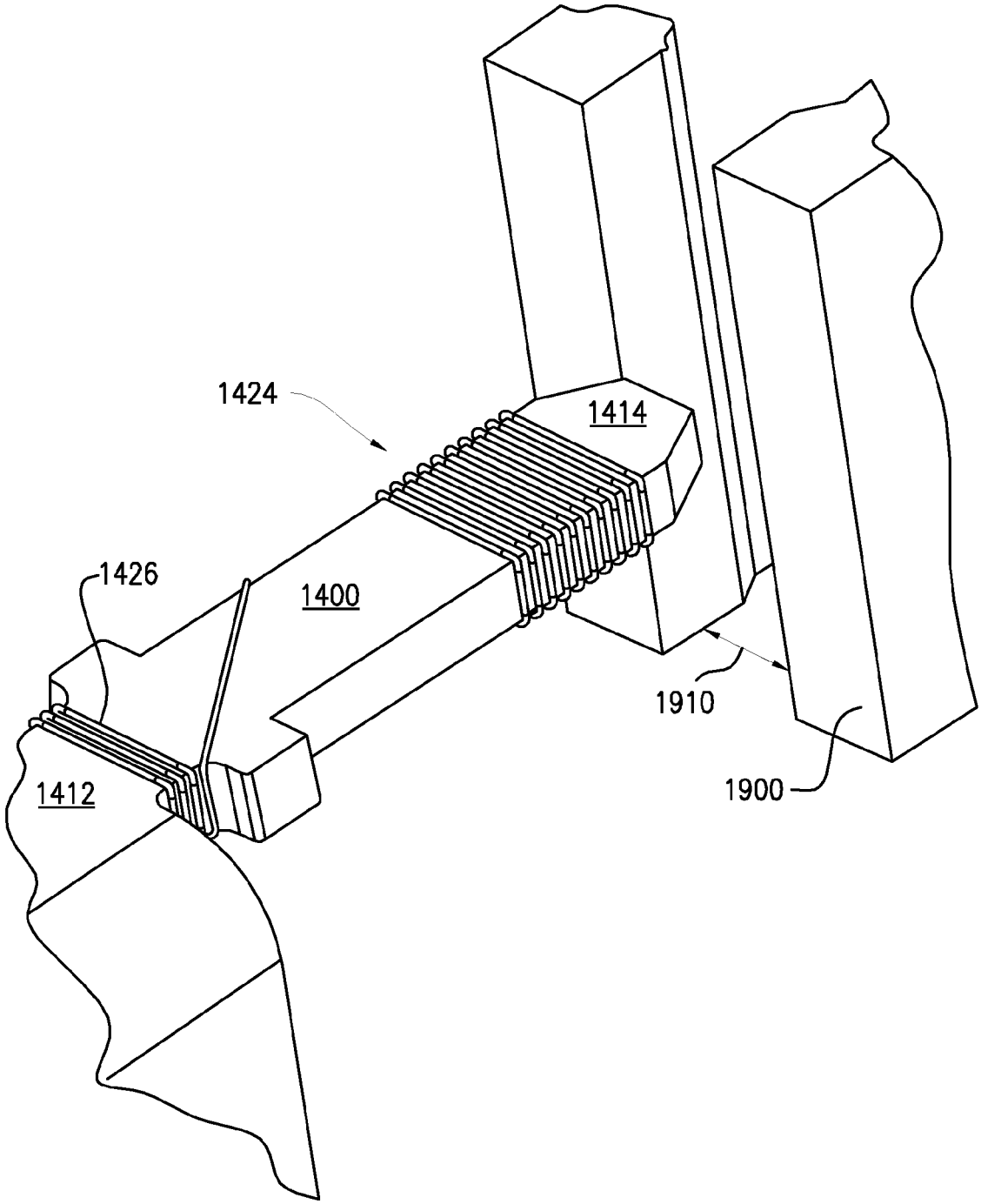
FIG. 27 is a perspective drawing of the appendage with wire loops wrapped about it in proximity to a wrap pusher, in accordance with one or more embodiments of the present invention.
Figure 28:
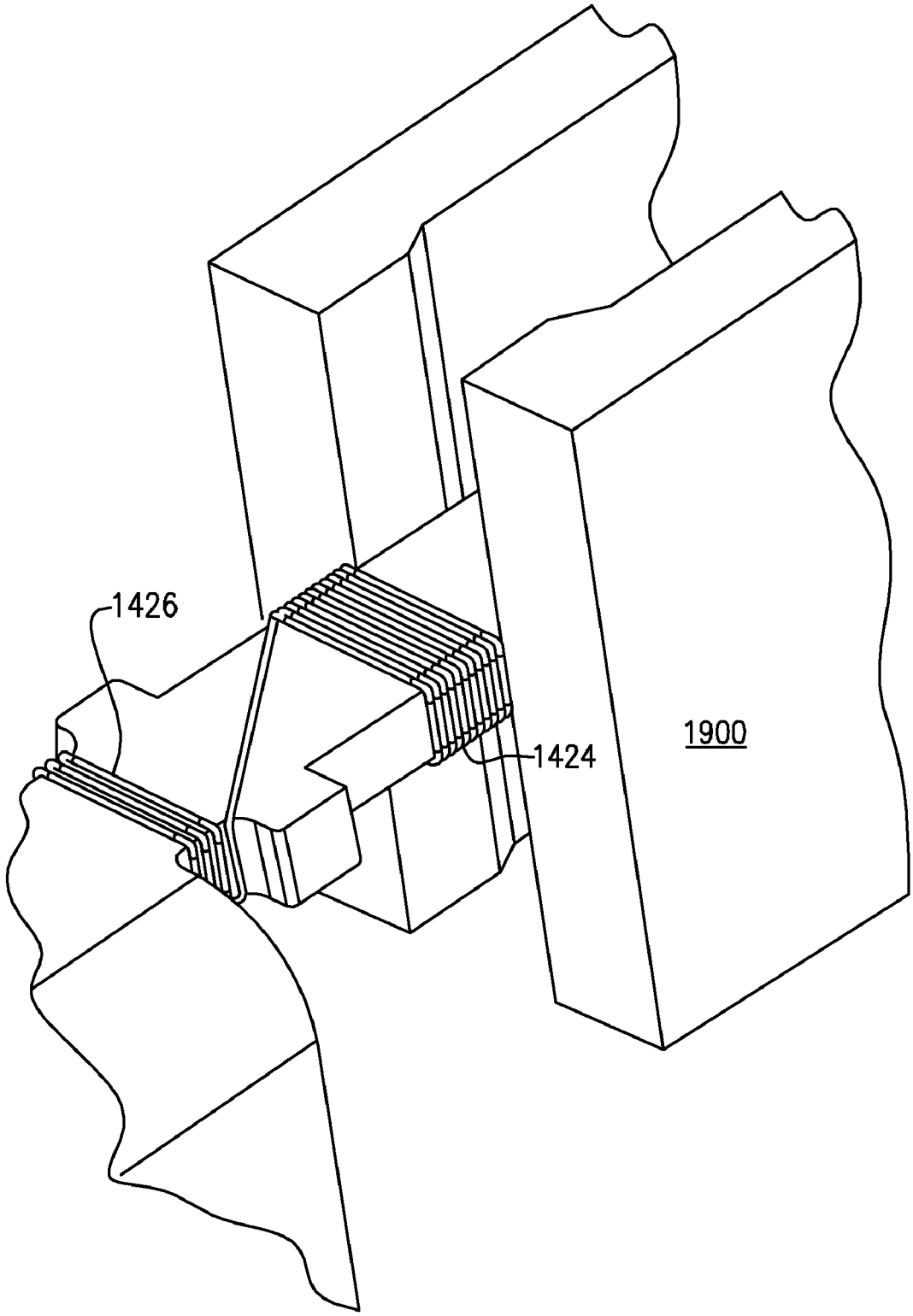
FIG. 28 is a perspective drawing of wrapped wire loops wraps being moved along the appendage in accordance with one or more embodiments of the present invention.
Figure 29:
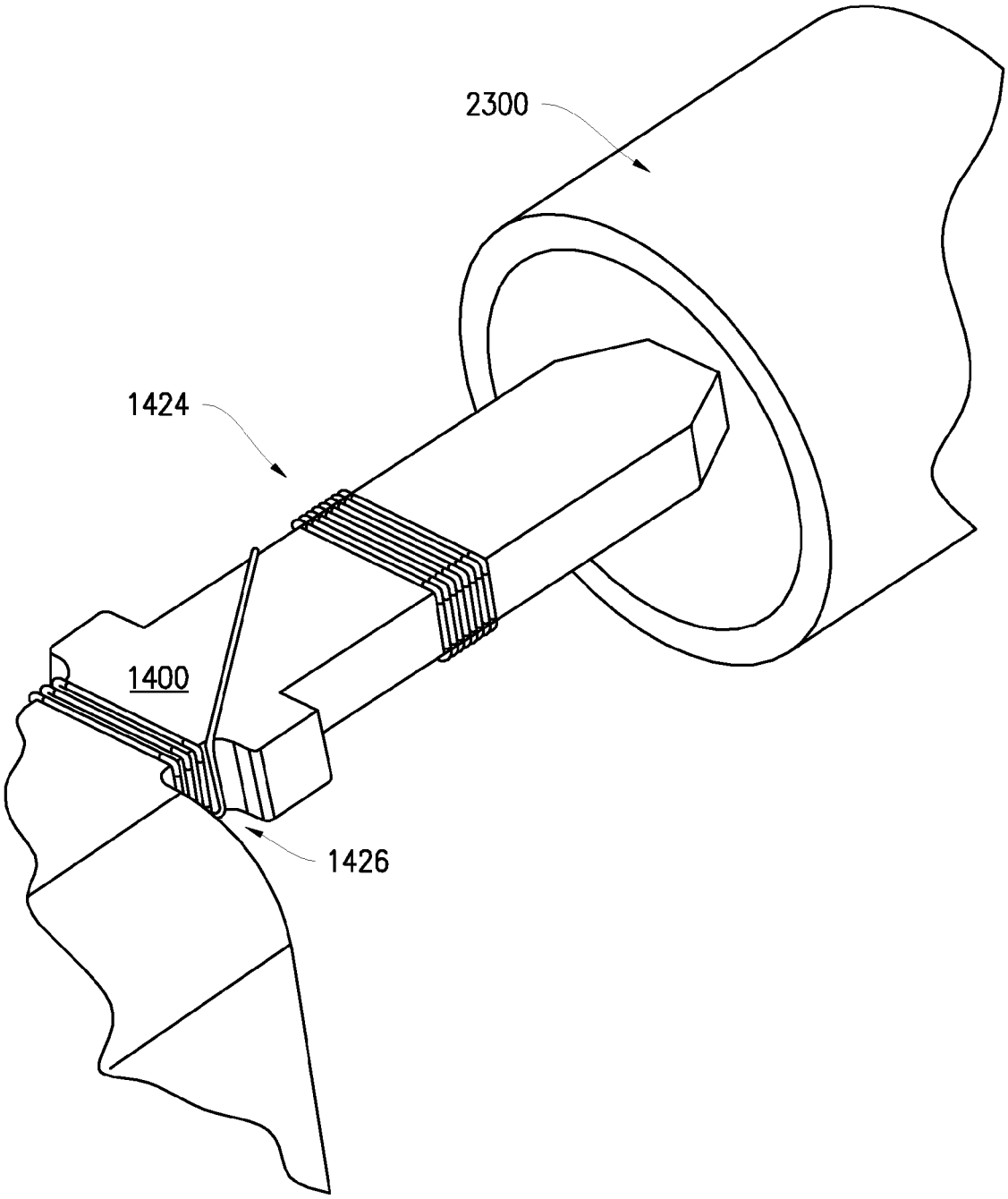
FIG. 29 is a perspective drawing of a shrink sleeve being positioned near the conductor appendage in accordance with one or more embodiments of the present invention.
Figure 30:
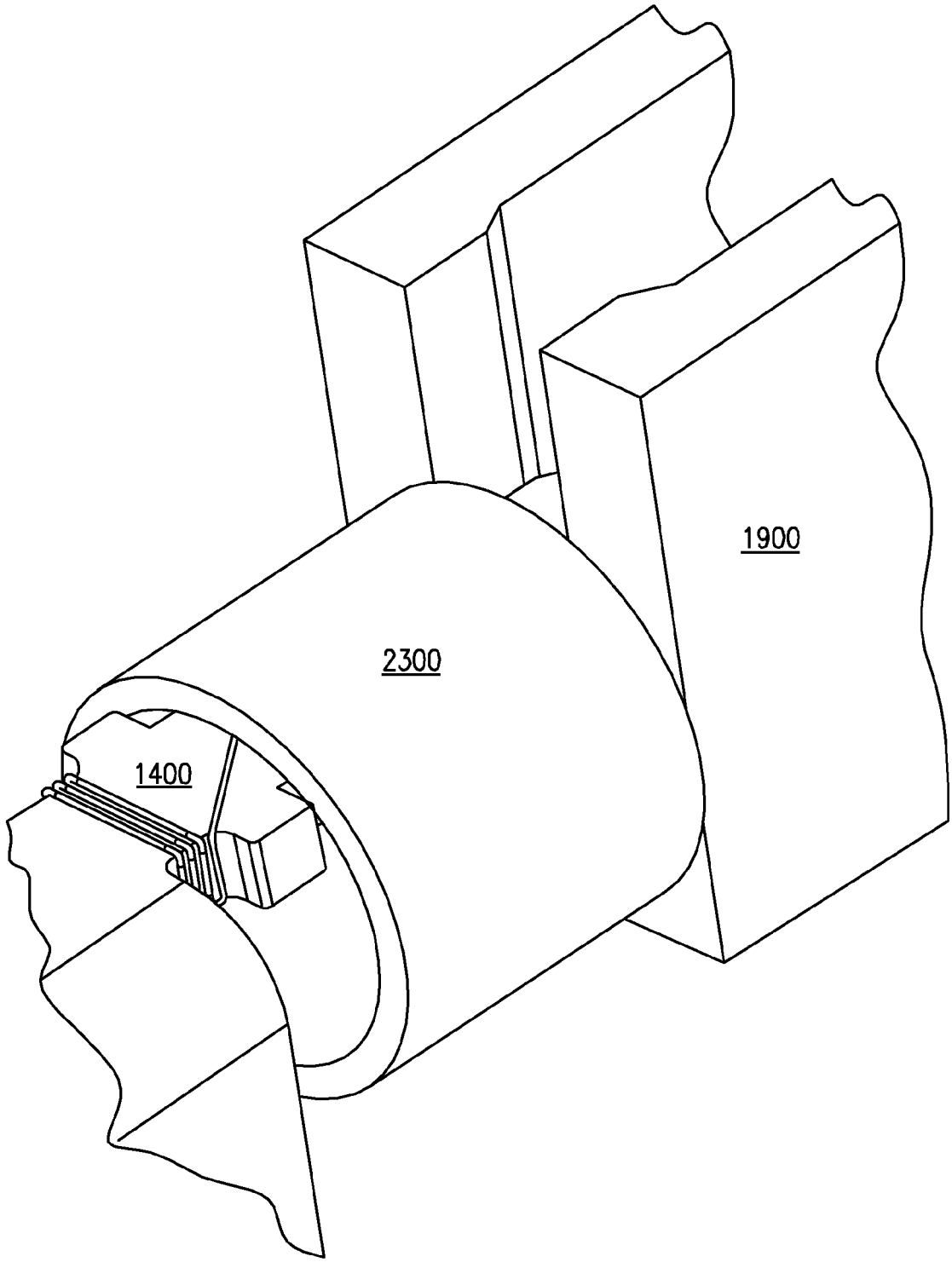
FIG. 30 is a perspective drawing of a shrink sleeve positioned around an appendage in accordance with one or more embodiments of the present invention.
Figure 31:
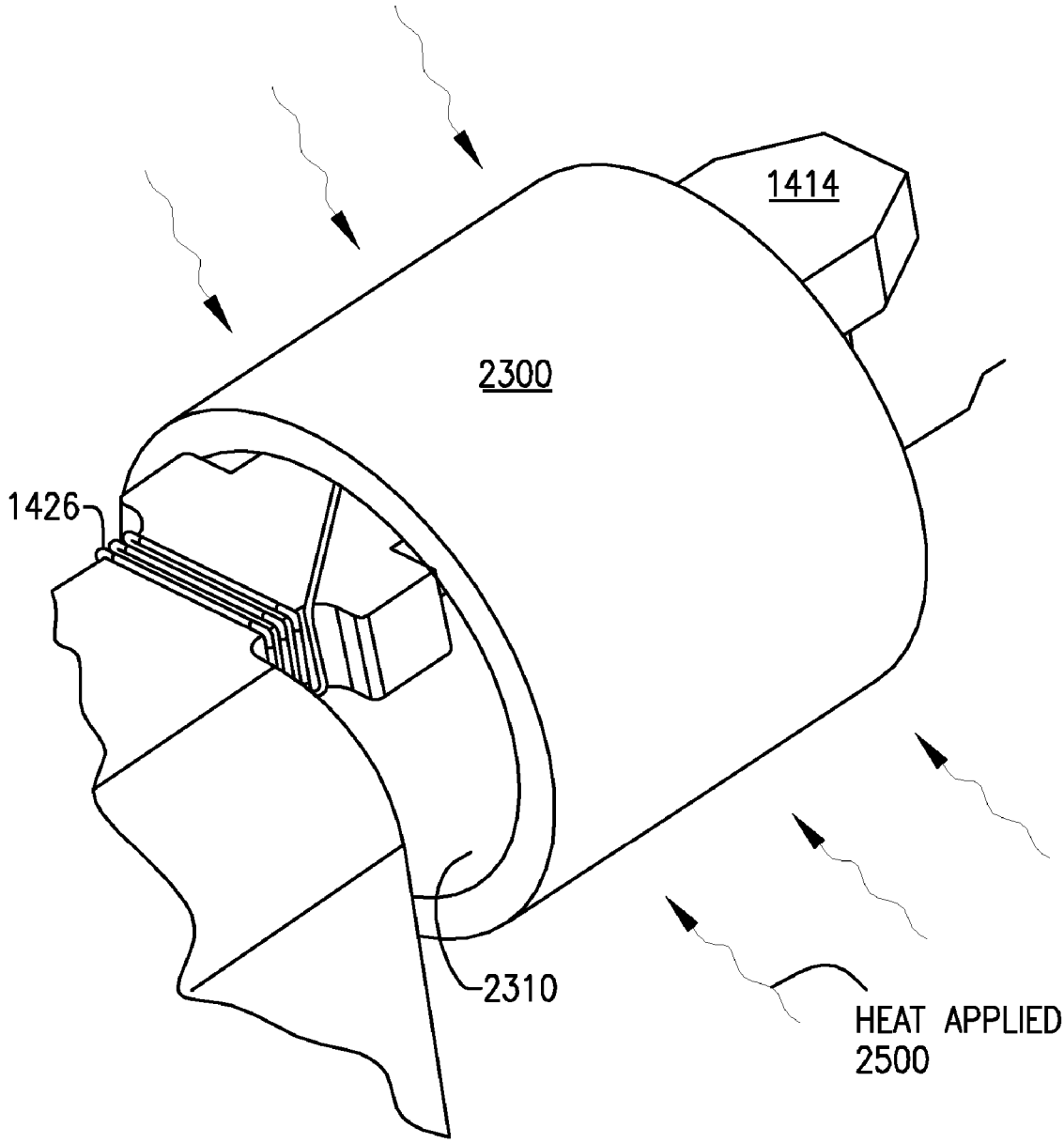
FIG. 31 is a perspective drawing of a shrink sleeve being sealed into position about the perimeter of an appendage having wire loops wrapped thereabout in accordance with one or more embodiments of the present invention.
Figure 32:
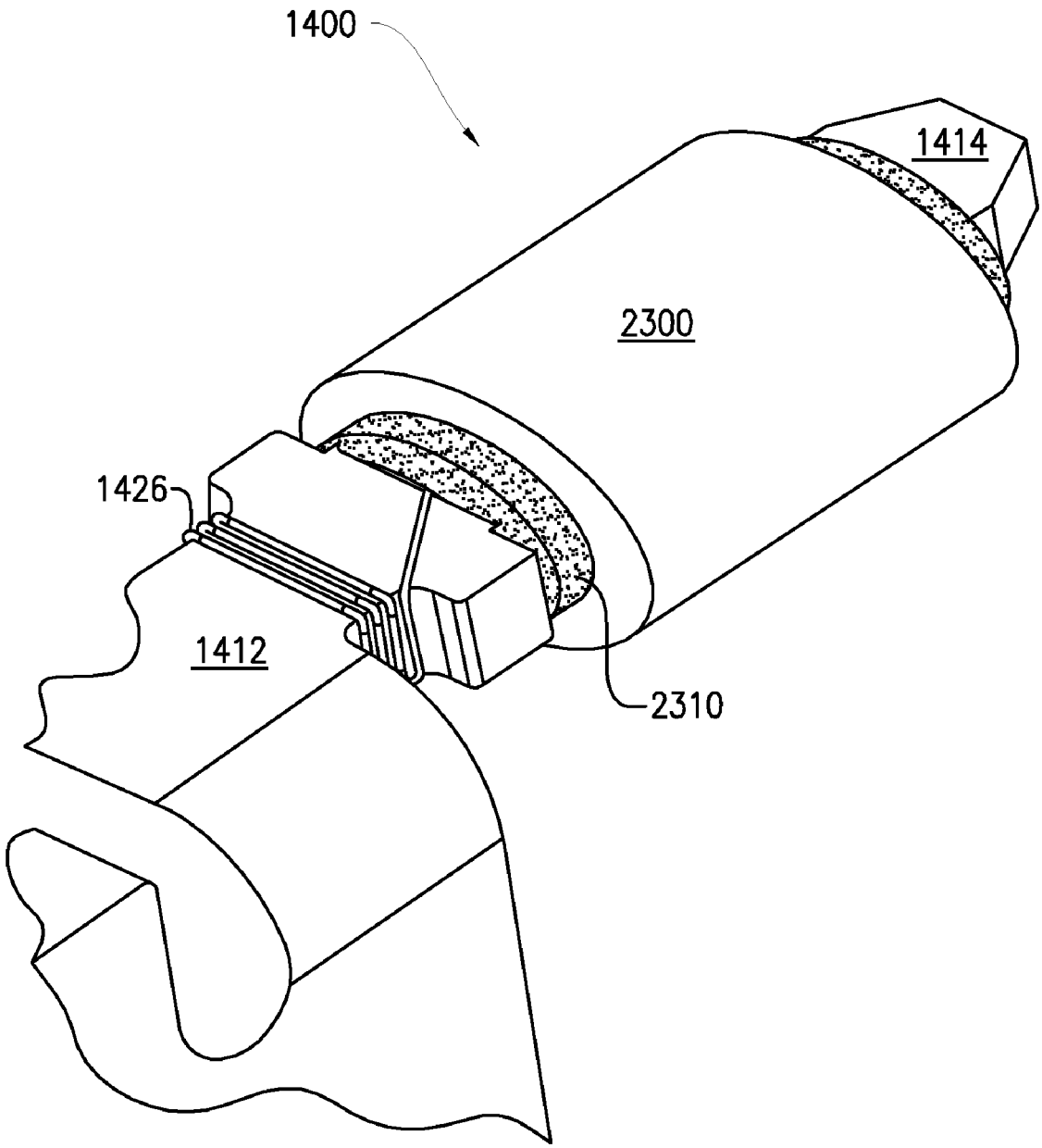
FIG. 32 is a perspective drawing of the shrink sleeve of FIG. 31 after being sealed into position about the perimeter of the appendage of FIG. 31, in accordance with one or more embodiments of the present invention.

A method of pushing the wire loops 1424 along the appendage 1400 in accordance with one or more embodiments of the invention is described in the following, with reference to FIGS. 27-28. The wound appendage 1400 with the anchoring wraps completed may be placed in a location which prevents undesirable motion of the appendage 1400. At each anchoring appendage 1400, a tool, such as wrap pusher 1900, that may include a slot 1910, may move so that the connector appendage tip 1414 enters the slot 1910. Prior to being pushed by wrap pusher 1900, loops 1424 have been wrapped employing a controlled wire tension and with controlled spacing between the neighboring loops 1424.

The slot 1910 may form a sliding fit with the appendage 1400. The wrap pusher 1900 may move towards the wire loops 1424 and may impinge against, or otherwise stated, press upon, the first wire loop. Continuing the motion of the wrap pusher 1900 with respect to the appendage 1400 may then compress the distribution of the wire loops 1424 into a confined space, until the loops 1424 are at least substantially adjacent to one another. Moreover, in addition to narrowing the distribution of the wire loops 1424, the wire loops as a whole may be pushed inward (that is, toward root 1412) along the appendage 1400.

In this way, insulation may be pierced and scraped from the wire 1420, thereby exposing the conducting material within wire 1420, as the wire is slightly stretched. Further motion may then press the conducting material of the wire 1420 to the appendage 1400, such as to corners 1422 of appendage 1400, thereby establishing conductive electrical contact between appendage 1400 and wire 1420. The motion of wire loops 1424 may then be stopped to avoid overstraining and/or breaking wire 1420.

Thereafter, with reference to FIGS. 29-32, a tube of shrink wrap plastic 2300 may be introduced in position over the appendage 1400 and wire loops 1424. The wrap pushing tool 1900 may be withdrawn, and the tube 2300 may be shrunk to insulate, protect and/or secure the wire loops 1424. Alternatively, a heat 2500 activated shrink tube 2300 with an adhesive layer 2310 on the internal surface of tube 2300 may be shrunk over the appendage 1400 and wire loops 1424. The heat shrink wrap 2300 may provide insulation and/or protection and may seal the appendage 1400 against intrusion of oxygen and/or other contaminants. Moreover, heat shrink wrap 2300 may effectively lock wire loops 1424 in place. The foregoing steps may operate to prevent fretting corrosion and loss of conductivity.

In one embodiment, the shrink wrap 2300 may not cover the few wire loops around the root 1412 of the appendage 1400. These uncovered wire loops 1426 may provide a strain relief which may support the relatively long span of unsupported wire from the appendage 1400 to the main coil winding and may prevent the vibration of this span from causing wire breakage at the stress-concentrating point where the wire 1420 enters the firm constraint of the encapsulation 2300. If the encapsulating material 2300 is soft and elastic than strain relief may not be required.

Another alternative is to use a resilient elastomer such as silicone rubber tube stretched over a form tube which is placed over the connector appendage 1400 and the wire loops 1424. The form tube may be removed while the rubber tube is stripped to compress tightly around the appendage 1400 and the wire loops 1424. This latter approach may present the advantage not needing heat. An adhesive and or a lubricant can be dispensed either onto the connector 1402 or into the tube as assembly takes place.

The shrink wrap 2300 method with the adhesive inner coating 2310 can have electrically conductive adhesive (not shown). This provides a back up so that in the event of a wire fracture that occurs within the adhesive 2310, the exposed ends of the wire 1402 may maintain contact through the conductive particles suspended in the adhesive 23 10. Although the resistance of conductive adhesive may exceed that of metal, the conductive adhesive may still provide an effective current path when coils are wound with very fine wire. Such coils may have relatively high resistance and are operated at higher voltages. Thus, the extra resistance of the adhesive is not enough to significantly change the operation of the connector 1402.

With lower voltage coils, which may have more robust wire, the total coil resistance may be much lower, and the extra resistance of the conductive adhesive 2310 could cause significant alteration of the coil conditions and at some point not provide the protection sought. However this concern may be moot because since such wire is more robust, the wire is less likely to fracture and therefore may not need the protection afforded by conductive adhesive 231 0. In view of the foregoing, coils with fine wires could be manufactured with shrink wraps 2300 that have conductive adhesive 2310, and coils with thicker wire could be manufactured with shrink wraps that employ non-conductive adhesive.

Another method of sealing the appendage 1400 with wire loops 1424 thereabout may involve omitting shrink wrap and applying adhesive directly to the wire 1420 that is wrapped around the connector appendage 1400 or the anchor post. As discussed above, such adhesive could be conductive or non-conductive in accordance with the gauge of the wire 1420, as discussed above.

Figure 33:
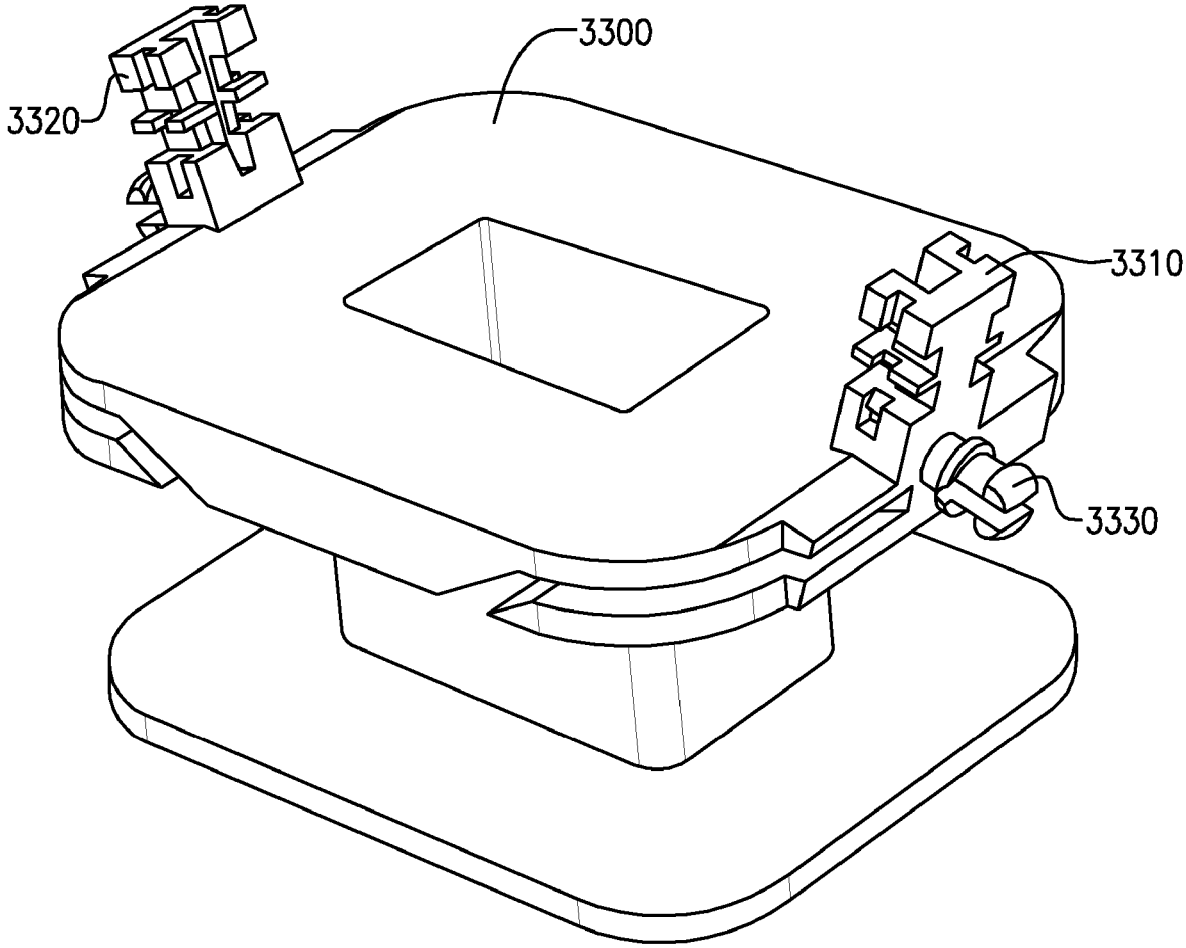
FIG. 33 is a perspective view of a complete bobbin in accordance with one or more embodiments of the present invention.

FIG. 33 shows a complete bobbin adaptable for use with one or more embodiments of the invention disclosed herein. Various earlier figures and earlier description segments address portions of a bobbin most relevant to various embodiments of the invention. The bobbin of FIG. 33 is provided as one example of a complete bobbin useable with those earlier-described and illustrated embodiments. Bobbin 3300 includes starting wire wrapping post 3310, finishing wire wrapping post 3320, and cap retainer and anchor post 3330.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An apparatus, comprising:

an electrical connector comprising a connector body having an end configured for engaging a bobbin and at least one contact pin extending from the connector body, the contact pin having at least a first cross-sectional dimension and at least a second cross-sectional dimension greater than the first cross-sectional dimension along a longitudinal axis thereof, and at least one edge, the contact pin configured to receive plural wire loops wrapped around a perimeter thereof and to extend through insulation coating the wire and establish conductive contact with the wire in response to movement of the wire loops along the longitudinal axis of the contact pin from the first cross-sectional dimension to the second cross-sectional dimension of the contact pin.

2. The apparatus of claim 1 wherein the contact pin forms a substantially permanent conductive connection to the wire upon extending through the insulation.

3. The apparatus of claim 1 wherein the cross-sectional geometry of the contact pin varies continuously along at least a portion of its length.

4. The apparatus of claim 1 wherein at least one of the following varies along a length of the contact pin:

a cross-sectional area of the contact pin;

a width of the contact pin; and a height of the contact pin.

5. The apparatus of claim 1 wherein at least one edge of the contact pin is operable to cut through insulation around the wire loops in response to the movement of the wire loops from the first cross-sectional dimension to the second cross-sectional dimension of the contact pin.

6. The apparatus of claim 1 wherein at least one of a top surface and a bottom surface extending along a length of the contact pin is tapered with respect to the longitudinal axis of the contact pin.

7. The apparatus of claim 1 wherein at least one side of the contact pin that extends along a length of the pin is tapered with respect to the longitudinal axis of the contact pin.

8. The apparatus of claim 1 wherein the contact pin comprises at least one constant-section perimeter zone extending along a portion of a length of the contact pin.

9. The apparatus of claim 1 wherein the contact pin comprises:

at least one region configured to accommodate an initial wrap of a selection of the wire loops.

10. The apparatus of claim 1 wherein the contact pin further comprises:

at least one region configured to accommodate a final wrap of the selection of the wire loops resulting from pushing the selection of the wire loops along a length of the contact pin.

11. The apparatus of claim 1 wherein the contact pin comprises:

at least one region configured to accommodate a wrap of a selection of the wire loops to provide strain relief.

12. The apparatus of claim 1 wherein the pin comprises at least one edge.

13. The apparatus of claim 12 wherein the at least one edge of the pin has sufficient sharpness to be able to cut through the wire insulation.

14. The apparatus of claim 13 wherein the at least one edge is operable to form a gas-tight connection with a metal conductor portion of the wire.

15. The apparatus of claim 1 wherein the contact pin comprises:

at least one edge having a taper angle with respect to the longitudinal axis of the contact pin.

16. The apparatus of claim 15 wherein the taper angle is between five and seven degrees.

17. The apparatus of claim 15 wherein the taper angle is about six degrees.

18. The apparatus of claim 15 wherein the taper angle is between thirteen and seventeen degrees.

19. The apparatus of claim 15 wherein the taper angle is about fifteen degrees.

20. The apparatus of claim 15 wherein the taper angle varies along a length of the contact pin.

21. The apparatus of claim 15 wherein the at least one edge of the contact pin is serrated along at least a portion of the length thereof.

22. The apparatus of claim 1 wherein the contact pin comprises:

at least one spring-loaded prong biased in at least one direction substantially perpendicular to a longitudinal axis of the contact pin.

23. The apparatus of claim 22 wherein the at least one spring-loaded prong comprises at least one cantilevered spring.

24. The apparatus of claim 22 wherein each said prong is biased in a first direction causing the prong to impinge against the insulation of the wire.

25. The apparatus of claim 22 wherein each said prong is biased in a second direction causing the prong to cut through the insulation to establish conductive electrical contact with a conductive metal portion of the wire.

26. The apparatus of claim 22 wherein the contact pin comprises:

two spring loaded prongs biased in opposite directions.

27. The apparatus of claim 1 further comprising:

a plurality of loops of at least one wire, coated with insulation material, wrapped around to the contact pin, wherein along at least one portion of the wire, at least one edge of the contact pin extends through the insulation material and thereby forms conductive electrical contact with the wire loops.

28. The apparatus of claim 27 wherein, at said at least one portion of the wire, the edge of the contact pin extends laterally into the insulation material of the wire and establishes conductive electrical contact with the wire.

29. The apparatus of claim 27 wherein the loops are wrapped around a bobbin having a hollow portion formed therein configured to accommodate the contact pin therein.

30. The apparatus of claim 29 further comprising:

a shrink wrap sleeve disposed around the wire loops and the bobbin.

31. The apparatus of claim 30 further comprising:

electrically conductive adhesive disposed between the bobbin and the shrink wrap sleeve.

32. apparatus of claim 31 wherein the electrically conductive adhesive comprises:

conductive particles suspended in the adhesive.

33. The apparatus of claim 27 wherein the wire is wrapped around a perimeter about the longitudinal axis of the contact pin.

34. The apparatus of claim 33 wherein a plurality of edges extending along a length of the contact pin pierce through the insulation material and thereby establish conductive electrical contact with the loops of conductive wire at a plurality of points around the perimeter of the contact pin.

* * * * *

UNITED STATES PATENT AND TRADEMARK OFFICE

CERTIFICATE OF CORRECTION

PATENT NO. : 7,753,715 B2
APPLICATION NO. : 11/619811
DATED : July 13, 2010
INVENTOR(S) : Anthony Freakes It is certified that error appears in the above-identified patent and that said Letters Patent is hereby corrected as shown below:

Col. 22, claim 27, line 2, after the word "around" delete the word "to"

Signed and Sealed this

Seventeenth Day of August, 2010

David J. Kappos

David J. Kappos
*Director of the United States Patent and Trademark Office*